US011251530B2

(12) United States Patent
Al Ahmad et al.

(10) Patent No.: US 11,251,530 B2
(45) Date of Patent: Feb. 15, 2022

(54) FREQUENCY AGILE ANTENNA

(71) Applicant: United Arab Emirates University, Al Ain (AE)

(72) Inventors: Mahmoud F. Y. Al Ahmad, Al Ain (AE); Ala' Abu Sanad, Al Ain (AE)

(73) Assignee: United Arab Emirates University, Al Ain (AE)

( * ) Notice: Subject to any disclaimer, the term of this patent is extended or adjusted under 35 U.S.C. 154(b) by 9 days.

(21) Appl. No.: 16/934,625

(22) Filed: Jul. 21, 2020

(65) Prior Publication Data

US 2021/0135367 A1 May 6, 2021

Related U.S. Application Data

(62) Division of application No. 16/676,002, filed on Nov. 6, 2019, now Pat. No. 10,790,590.

(51) Int. Cl.

| | |
|---|---|
| ***H01Q 9/04*** | (2006.01) |
| ***H01Q 1/48*** | (2006.01) |
| ***H01Q 13/10*** | (2006.01) |

(52) U.S. Cl.

CPC ..... *H01Q 9/0442* (2013.01); *H01Q 1/48* (2013.01); *H01Q 13/103* (2013.01)

(58) Field of Classification Search

CPC ..... H01Q 9/0442; H01Q 13/103; H01Q 1/48

See application file for complete search history.

(56) References Cited

U.S. PATENT DOCUMENTS

| | | | | |
|---|---|---|---|---|
| 4,367,474 | A | 1/1983 | Schaubert et al. | |
| 5,777,581 | A | 7/1998 | Lilly et al. | |
| 5,943,016 | A * | 8/1999 | Snyder, Jr. | H01Q 1/38 343/700 MS |
| 6,061,025 | A * | 5/2000 | Jackson | H01Q 1/38 343/700 MS |
| 6,181,281 | B1 | 1/2001 | Desclos et al. | |
| 6,211,825 | B1 * | 4/2001 | Deng | H01Q 1/38 343/700 MS |
| 6,501,427 | B1 | 12/2002 | Lilly et al. | |
| 6,549,169 | B1 * | 4/2003 | Matsuyoshi | H01Q 1/243 343/702 |
| 7,260,424 | B2 * | 8/2007 | Schmidt | H01Q 1/241 343/702 |
| 7,348,928 | B2 * | 3/2008 | Ma | H01Q 13/103 343/767 |
| 8,654,012 | B2 * | 2/2014 | Kim | H01Q 1/2208 343/700 MS |
| 9,059,519 | B2 * | 6/2015 | Lin | H01Q 9/045 |
| 9,711,849 | B1 * | 7/2017 | Chen | H01Q 3/247 |
| 10,008,777 | B1 * | 6/2018 | Broyde | H01Q 5/321 |

(Continued)

*Primary Examiner* — Dameon E Levi
*Assistant Examiner* — Jennifer F Hu
(74) *Attorney, Agent, or Firm* — Boyle Fredrickson, S.C.

(57) ABSTRACT

Multiple frequency agile antenna structures are described. Each of the structures allows for tuning the antenna by changing its shape geometry (without changing the overall length of the antenna) and altering the frequency characteristics using variable capacitors. This is done by allowing control of the resonant frequency of the antenna with one main tunable capacitor and for independently varying the frequency and bandwidth of the antenna structure with the use of additional tunable capacitors embedded in the antenna structure.

12 Claims, 22 Drawing Sheets
(22 of 22 Drawing Sheet(s) Filed in Color)

(56) References Cited

U.S. PATENT DOCUMENTS

| | | | | |
|---|---|---|---|---|
| 2003/0219035 | A1* | 11/2003 | Schmidt | H04B 1/005 370/478 |
| 2004/0008140 | A1 | 1/2004 | Sengupta et al. | |
| 2006/0256014 | A1 | 11/2006 | Sengupta et al. | |
| 2008/0180328 | A1* | 7/2008 | Yamagajo | H01Q 9/0442 343/700 MS |
| 2017/0141473 | A1* | 5/2017 | Sharawi | H01Q 1/48 |

* cited by examiner

2400

2500

FREQUENCY AGILE ANTENNA

CROSS-REFERENCE TO RELATED APPLICATIONS

This application is a divisional application of Non-Provisional application Ser. No. 16/676,002 filed on 6 Nov. 2019, entitled "Frequency Agile Antenna", the entirety of which is hereby incorporated by reference.

TECHNICAL FIELD

This invention relates generally to an antenna architecture and more specifically to frequency agile antenna structures.

BACKGROUND

Traditionally, every antenna operates on certain frequency and bandwidth with specific radiation pattern. These parameters are related to the dimension of the antenna (electrical length). To shift to a different bandwidth and frequency, a completely independent antenna (with different electrical length) is required.

Steady growth and increment in communication services and applications calls for the implementation and utilization of dynamic and reconfigurable communication approaches. The use of agile based frequency reconfiguration is one of these approaches and technology that allows for tunability. Among the different tuning technologies are semiconductor and barium strontium titanate (BST). Both have advantages of continuous tunability and potential for applications in tunable devices and circuits designs.

In the last decade, growth in Global Navigation Satellite Systems (GNSS) based positioning techniques using evolved infrastructure along with the integration technologies, are setting the stage for a wide spread of applications such as automatic location, tracking and navigation based systems. GNSS based systems should technically allow interoperability and compatibility between various satellite navigation systems. If satellite navigation signals exhibit power levels below receiver thermal noise levels on the earth's surface, the degradation in the signal to noise level will affect the receiver performance and will limit the use of GNSS for high integrity operations. Other issues such as jamming and spoofing require mitigation. This calls for high quality performance and functionality of involved components.

Therefore, there is a desire in the field for antenna components for having frequency agility capability as a key feature and design element, which will provide potential operational improvement and enhancement by increasing range of tuning at low cost.

SUMMARY OF THE INVENTION

The invention has several aspects. In one aspect, a frequency agile antenna is described. The antenna comprises: an electrically conductive ground plane; an electrically conductive patch metallization plane; and a dielectric plane positioned between the ground plane and the patch metallization plane, the dielectric plane substantially parallel to each of the ground plane and the patch metallization plane. The patch metallization plane comprises a first part and a second part separated from the first part by a spacing. Each of the first and second parts extend along an axis of the dielectric plane and have electrically conducting segmented metallization slots, which comprise: a main metallization slot; and a second metallization slot coupled at one side to a third metallization slot by a tuning capacitor. The second metallization slot also is coupled to the main metallization slot at a second side by a DC blocking capacitor. The first part forms a mirror image of the second part. Also, the main metallization slot of the first part is coupled by a second tuning capacitor to the main metallization slot of the second part. Further, the first part is distinguished from the second part by having a PIN and an input port in the main metallization slot of the first part. In the described antenna, the tuning capacitor of the first and second part and the second tuning capacitor are configured for independently varying a bandwidth and a frequency of the frequency agile antenna.

In a related embodiment, the main metallization slot has a shape defining a strip section and a main section, the strip section and the main section having the same orientation and the strip section is connected to the main section at one edge, the one edge defining a gap between a side of the strip section and an opposing side of the main section, the gap oriented to point outward from the frequency agile antenna, wherein the PIN and the input port are located at the main section of the first part.

In another related embodiment, the main metallization slot, second metallization slot and the third metallization slot are oriented to have the same orientation.

In a related embodiment, the spacing between the main metallization slot and the second metallization slot is different from spacing between the second metallization slot and the third metallization slot.

In another related embodiment, the main metallization slot, second metallization slot and third metallization slot have the same width. Also, the second metallization slot is different in length from the third metallization slot and the main metallization slot is longer than either the second metallization slot or the third metallization slot.

In another related embodiment, the tuning capacitor of the first and second parts is different from the second tuning capacitor. Also, the second tuning capacitor is tunable to change the coupling between the main metallization slot of the first part and the main metallization slot of the second part.

In a related embodiment, the antenna further comprises a control system for configuring the tuning capacitor in the first and second part and the second tuning capacitor to achieve a desired operational frequency and bandwidth, the control system comprises a processor configured to: obtain the desired operational frequency and bandwidth as an input; access a lookup table comprising different sets of capacitance values for the tuning capacitor in the first and second part and the second tuning capacitor, the different sets of capacitance values corresponding to capacitance values for different pre-determined operational frequencies and bandwidths; select from the lookup table a set of capacitance values corresponding to the desired operational frequency and bandwidth; and vary the capacitance of the tuning capacitor in the first and second part and the second tuning capacitor to correspond to the selected capacitance values.

Another aspect of the invention describes a frequency agile antenna comprising: an electrically conductive ground plane; an electrically conductive patch metallization plane; and a dielectric plane positioned between the ground plane and the patch metallization plane, where the dielectric plane is substantially parallel to each of the ground plane and the patch metallization plane. The patch metallization plane comprises a first part and a second part separated from the first part by a spacing. Each of the first and second parts extending along an axis of the dielectric plane and having electrically conducting segmented metallization slots comprising: a main metallization slot; and a second metallization slot coupled at one side to a third metallization slot by a tuning capacitor. The second and third metallization slots have an orientation substantially vertical to the main metallization slot and are separated from the main metallization slot by a second spacing. The main metallization slot of the first part forms a mirror image of and is coupled by a second tuning capacitor to the main metallization slot of the second part. The main metallization slot in the first part is distinguished from the main metallization slot in the second part by having a PIN and an input port. The second metallization slot and the third metallization slot of the first part and second part have the same orientation and are separated by a third spacing. In the described antenna, the tuning capacitor of the first and second part and the second tuning capacitor are configured for independently varying a bandwidth and a frequency of the frequency agile antenna.

In a related embodiment, the main metallization slot has a shape defining a strip section and a main section, the strip section and the main section having the same orientation and the strip section connected to the main section at one edge, the one edge defining a gap between a side of the strip section and an opposing side of the main section, the gap oriented to point outward from the frequency agile antenna, where the PIN and the input port are located at the main section.

In a related embodiment, the main metallization slot, second metallization slot and third metallization slot have the same width. Also, the second metallization slot is different in length from the third metallization slot and the main metallization is longer than either the second metallization slot or the third metallization slot.

In another related embodiment, the tuning capacitor is different from the second tuning capacitor and. Also, the second tuning capacitor is tunable to change the coupling between the main metallization slot of the first part and the main metallization slot of the second part.

In yet another related embodiment, the antenna further comprises a control system for configuring the tuning capacitor in the first and second part and the second tuning capacitor to achieve a desired operational frequency and bandwidth. The control system comprises a processor configured to: obtain the desired operational frequency and bandwidth as an input; access a lookup table comprising different sets of capacitance values for the tuning capacitor in the first and second part and the second tuning capacitor, the different sets of capacitance values corresponding to capacitance values for different pre-determined operational frequencies and bandwidths; select from the lookup table a set of capacitance values corresponding to the desired operational frequency and bandwidth; and vary the capacitance of the tuning capacitor in the first and second part and the second tuning capacitor to correspond to the selected capacitance values.

Another aspect of the invention describes a frequency agile antenna comprising: an electrically conductive ground plane; an electrically conductive patch metallization plane; and a dielectric plane positioned between the ground plane and the patch metallization plane, the dielectric plane substantially parallel to each of the ground plane and the patch metallization plane. The patch metallization plane comprises: a first part extending along a width of the dielectric plane, the first part having a first metallization slot and a second metallization slot separated from each other by a first spacing and connected to each other at one edge by a first connecting metallization. Also, the first metallization slot having a PIN and an input port. The patch metallization plane also comprises a second part extending along the width of the dielectric plane and separated from the first part by a spacing, the second part having a first metallization slot and a second metallization slot separated from each other by a second spacing and connected to each other at one edge by a second connecting metallization that is positioned opposite the first connecting metallization. The spacing has two wide sections mirrored along an axis formed by a narrow section formed between the first connecting metallization and second connecting metallization, where the second part is coupled to the first part at the narrow section by a tuning capacitor. The patch metallization also comprises a third metallization slot coupled at one side to a fourth metallization slot by a second tuning capacitor, the third and fourth metallization slots having an orientation substantially vertical to the first metallization slot of the second part and are separated from the first metallization slot of the second part by a third spacing. The patch metallization further comprises a fifth metallization slot coupled at one side to a sixth metallization slot by a third tuning capacitor, the fifth and sixth metallization slots having an orientation substantially vertical to the second metallization slot of the second part and are separated from the second metallization slot of the second part by a fourth spacing. In the described antenna, the tuning capacitor, the second tuning capacitor and the third tuning capacitor are configured for independently varying a bandwidth and a frequency of the frequency agile antenna.

In a related embodiment, the first metallization slot and the second metallization slot of the first part, the first metallization slot and the second metallization slot of the second part, the third, fourth, fifth and sixth metallization slots all have the same width.

In a related embodiment, the tuning capacitor is different from the second tuning capacitor and the third tuning capacitor. Also, the tuning capacitor is tunable to change the coupling between the first part and the second part.

In yet another related embodiment, the described antenna comprises a control system for configuring the tuning capacitor, the second tuning capacitor and the third tuning capacitor to achieve a desired operation frequency and bandwidth. The control system comprises a processor configured to: obtain the desired operational frequency and bandwidth as an input; access a lookup table comprising different sets of capacitance values for the tuning capacitor, the second tuning capacitor and the third tuning capacitor, the different sets of capacitance values corresponding to capacitance values for different pre-determined operational frequencies and bandwidths; select from the lookup table a set of capacitance values corresponding to the desired operational frequency and bandwidth; and vary the capacitance of the tuning capacitor in the first and second part and the second tuning capacitor to correspond to the selected capacitance values.

Another aspect of the invention describes a frequency agile antenna comprising: an electrically conductive ground plane; an electrically conductive patch metallization plane; and a dielectric plane positioned between the ground plane and the patch metallization plane, the dielectric plane substantially parallel to each of the ground plane and the patch metallization plane. The patch metallization plane comprises: a first part extending along a width of the dielectric plane, the first part having a first metallization slot and a second metallization slot separated from each other by a first spacing and connected to each other at one edge by a first connecting metallization, the first metallization slot having a PIN and an input port. The patch metallization also comprises a second part extending along the width of the dielectric plane and is separated from the first part by a spacing. The second part having a first metallization slot and a second metallization slot separated from each other by a second spacing and connected to each other at one edge by a second connecting metallization that is positioned opposite the first connecting metallization. The spacing has two wide sections mirrored along an axis formed by a narrow section formed between the first connecting metallization and the second connecting metallization, the second part is coupled to the first part at the narrow section by a tuning capacitor. The patch metallization plane also comprises a third metallization slot coupled at one side to a fourth metallization slot by a second tuning capacitor, where the third and fourth metallization slots have the same width and the third metallization slot is coupled to the first metallization slot of the second part by a first DC blocking capacitor. The match metallization plane also comprises a fifth metallization slot coupled at one side to a sixth metallization slot by a third tuning capacitor, where the fifth and sixth metallization slots have the same width, and the fifth metallization slot is coupled to the second metallization slot of the second part by a second DC blocking capacitor. In the described antenna, the tuning capacitor, the second tuning capacitor and the third tuning capacitor are configured for independently varying a bandwidth and a frequency of the frequency agile antenna.

In a related embodiment, the first metallization slot and the second metallization slot of the first part, the first metallization slot and the second metallization slot of the second part, the third, fourth, fifth and sixth metallization slots all have the same width.

In another related embodiment, the tuning capacitor is different from the second tuning capacitor and the third tuning capacitor. Also, the tuning capacitor is tunable to change the coupling between the first part and the second part.

In yet another related embodiment, the antenna further comprises a control system for configuring the tuning capacitor, the second tuning capacitor and the third tuning capacitor to achieve a desired operational frequency and bandwidth. The control system comprises a processor configured to: obtain the desired operational frequency and bandwidth as an input; access a lookup table comprising different sets of capacitance values for the tuning capacitor, the second tuning capacitor and the third tuning capacitor, the different sets of capacitance values corresponding to capacitance values for different pre-determined operational frequencies and bandwidths; select from the lookup table a set of capacitance values corresponding to the desired operational frequency and bandwidth; and vary the capacitance of the tuning capacitor in the first and second part and the second tuning capacitor to correspond to the selected capacitance values.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings illustrate non-limiting example embodiments of the present disclosure.

FIG. 14*l* shows a simulation of a frequency response for the antenna structures in FIG. 14*b*, FIG. 14*j* and FIG. 14*k*, where the resonant frequencies are depicted

DETAILED DESCRIPTION

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the system to the precise forms of any example embodiment. Accordingly, the description and drawings are to be regarded in an illustrative, rather than a restrictive, sense.

Typically, the antenna geometrical dimension is proportional to the wavelength of interest for such antenna. To force an antenna that has been designed at specific wavelength to operate at a lower frequency, a PIN (via hole) is usually used to couple the antenna metallization structure to the ground plane. Such action has the effect of permanently shifting down the operating frequency of the antenna as long as the PIN is in place. Other techniques have been developed in the field to achieve the same result by tuning the frequency through the introduction of various electrical components in the design of the antenna structure. Such techniques, however, usually lead to major losses and mismatch due to the insertion of different discrete elements to the metallization pads of the antenna structure.

The current invention provides an alternative antenna design for achieving the same result, with low losses and better matching when tuned over relatively high tuning frequency range. The current invention allows for tuning the antenna by changing its shape geometry (without changing the overall length of the antenna) and altering the frequency characteristics using variable capacitors. This is done by allowing control of the resonant frequency of the antenna with one main tunable capacitor and for independently varying the frequency and bandwidth of the antenna structure with the use of additional tunable capacitors embedded in the structure as will be described in detail below.

Typically, the electrical length of the antenna is proportional to the physical length of the antenna patch metallization. By using tunable capacitors, this allows for increasing the electrical length without increasing the physical dimension of the patch. The modified electrical length exhibits its high value when the capacitor assumes its high value and decreases when the capacitor is decreased. As such, the current invention shows that the antenna frequency response is inversely proportional to the length of the patch, i.e. to the tunable capacitor.

Figure 1:
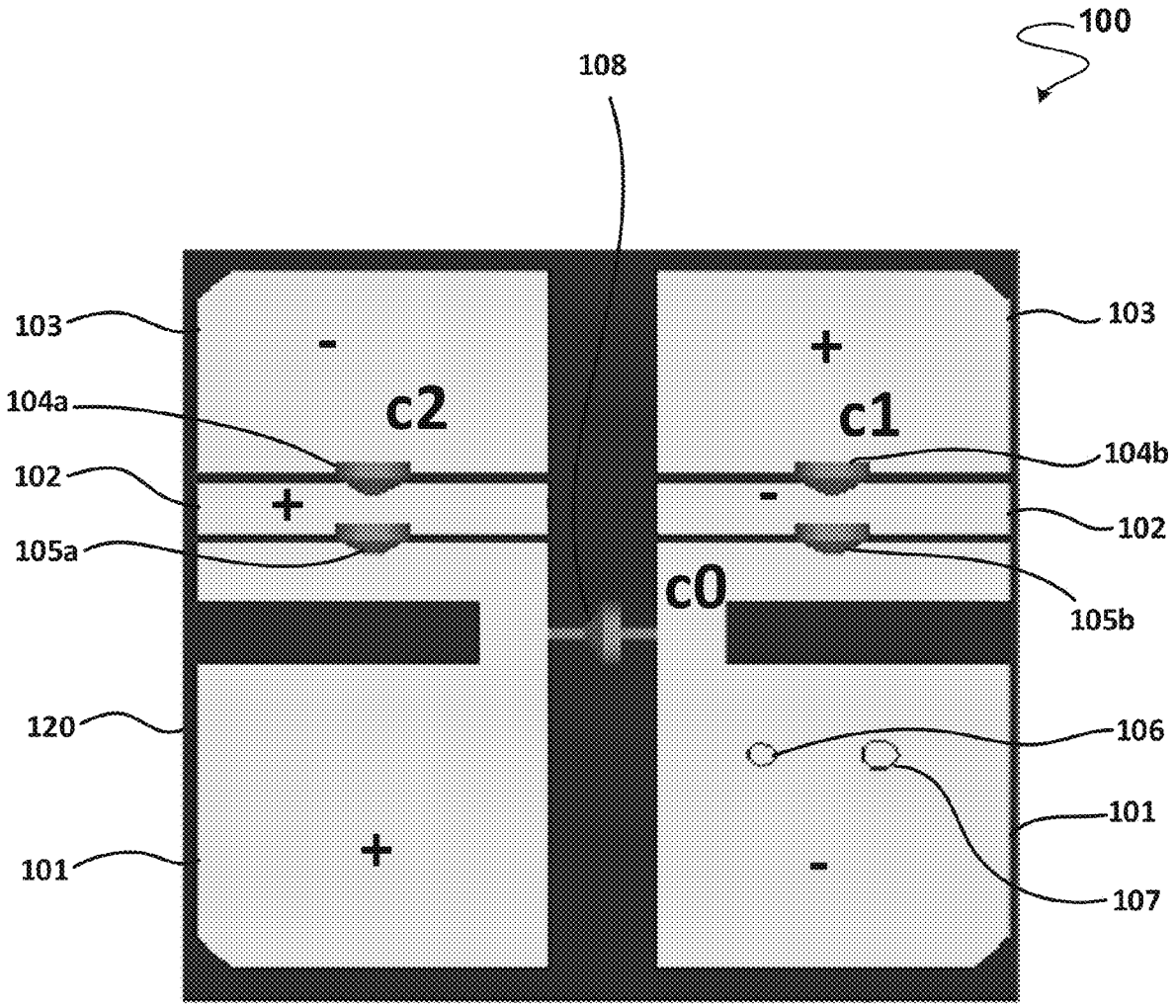
FIG. 1 shows a planner schematic view of an antenna structure allowing for agile frequency tuning according to an embodiment of the invention.

FIG. 1 shows a schematic planner view of an antenna metallization structure according to an exemplary embodiment of the invention. The antenna structure comprises the patch metallization 100 plane shown in FIG. 1 as well as a ground plane (not shown) separated from the patch metallization plane by a substrate dielectric (capacitance) plane 1720, where all three planes are substantially parallel to one another. In some embodiments, etching the substrate between the metallization top and the ground will help improve the antenna characteristics.

The patch metallization pattern 100 shown in FIG. 1 comprises two identical parts (left and right), where one of the sections (right in this exemplary embodiment) is distinguishable from the other by having a PIN (via hole) 106 and an input port 107 in its main metallization pad. This exemplary structure is designed on a Substrate 1720, which may be made from FR4 or any other low loss dielectric materials known in the art. The metallization may be made from gold or any other low loss conductor known in the art. The dimensions of the sections are linked to the wavelength of the operational frequency of the antenna. In this embodiment, the two sections are assumed to have substantially similar dimensions. The antenna's final size is also understood to correspond to the desired operational wavelength, where the size is understood to be less than the wavelength due to the PIN insertion. Each of the two sections is shown to have a main metallization pad 101, a second metallization pad 102 and a third metallization pad 103. Main metallization pad is shown to be larger in size than either of pads 102 or 103. Pads 102 and 103 may be of the same or different dimensions.

All three metallization pads are shown to be co-planner and spaced apart from one another. The spacing between the metallization pads may be the same or different. The Spacing may range from $\lambda/8$ up to micrometers, where A is the wavelength. At the $\lambda/8$ range, the circuit coupling capacitance behaves like an open circuit (i.e. approximately having a zero value). Meanwhile the very narrowband gap results in stronger mutual coupling. This disclosure covers the ability to tune this coupling, which plays a role in the tunability of the frequency characteristics. As such, the exemplary structure described provides a pre-determined initial coupling strength. Adding capacitors to bridge the gap, allows this coupling to be varied depending on the capacitance value.

In relation to the spacing between the metallization pads, it is to be understood that the spacing is used to introduce capacitive coupling between the pads. The positioning of the spacing in relation to the entire metallization pattern generated from the compilation of the pads is designed to achieve maximum possible capacitive coupling between the metallization pads. Each set of metallization pad exhibits a specific electrical length. In the most preferred embodiment, the spacing between the metallization pads in the set of pads is optimized within the structure to exhibit the maximum tunability when a capacitor is inserted in that spacing.

In the exemplary embodiment described, the length of the spacing is shown to be adjacent with the pad dimensions. The width of the spacing is described as above and is noted to play an important role in the coupling across the spacing. Namely, the width of the spacing, hereinafter also reference simply as the spacing, determines the frequency resonance bandwidth characteristics of the antenna structure. Using wider spacing allows for achieving narrow bands and vice versa. It is to be noted that the wider the spacing, the weaker the electromagnetic interaction becomes between the pads separated by such spacing. In a preferred embodiment, the spacing between the pads is optimized such that the antenna structure can still exhibit reasonable electromagnetic reactions between the pads, when the capacitor value assumes its minimum value.

Metallization pads 102 and 103 are shown to have a horizontal orientation in relation to metallization pad 101. Metallization pad 102 is shown to be positioned between metallization pads 101 and 103. FIG. 1 also shows tunable variable capacitor 104*a* (left) and 104*b* (right) coupling metallization pads 102 and 103. FIG. 1 also shows a DC blocking capacitor 105*a* (left) an 105*b* (right) coupling metallization pads 101 and 102. A tunable variable capacitor 108 is show to electrically couple metallization pad 101 of the left and right sections of patch antenna 100.

Capacitors 104*a* and 104*b* allow for changing the coupling between metallization pads 102 and 103, which are coupled by capacitor 104*a* (left) or 104*b* (right). In some embodiments, a tunable capacitor with 5:1 tuning range may be used. It is to be understood that the tuning in frequency and/or bandwidth is inversely proportional to the square root of tuning capacitor value. By way of non-limiting example, in some embodiments, the tunable capacitor used has a range of 9.63 pF to 0.84 pF. Tunable variable capacitor 108 is used to change the coupling between the two main metallization pads 101 of the right and left sections of patch antenna 100. Tunable variable capacitor 108 may be the same or different from tunable variable capacitor 104*a*/104*b*. It is to be understood that tunable capacitor 108 may have the same characteristics and limitations as tunable variable capacitor 104*a*/104*b*.

DC blocking capacitors 105*a*/105*b* are used to prevent DC bias applied to the variable capacitor 104*a*/104*b*, respectively, from propagating back to the antenna input port 107. It is to be understood that this is usually presented as SMD components and depends on the applied voltage bias. In a non-limiting example, such DC blocking capacitor may have a value of 10 nF. However, it is to be understood that a value of 560 μF may work better.

Introducing the DC blocking allows for creating three independent biasing schemes. The blocking capacitor acts as a short circuit in the high frequency regime and acts as open circuit in the DC bias regime due to its very high capacitance value, which does not allow voltage to propagate into or out the confined region. The use of DC blocking capacitors allows for splitting the antenna metallization structure to two identical sections, each comprising three pads. Pads 101 and 102 in the DC analysis are shorted together due to the blocking capacitor, i.e. they are electrically connected. Meanwhile, in high frequency analysis, they are disconnected and their polarity is identical. FIG. 1 shows the three biasing areas represented by a plurality scheme (represented by the positive and negative polarity signs), when all described capacitors are present and where pads 101 and 102 are shown to be shorted together.

Dividing the antenna metallization structure to separate elements (slots) couplable by tunable capacitors creates capacitance and inductive structures, which help in creating resonance radiating structure configurable to have independent and simultaneous frequency and bandwidth turning. The creation of slots in the metallization structure also alters the impedance phase relations, which allows for frequency tunability when the tunable variable capacitors are added between the metallization pads (slots). The specific shape of the antenna provides guidelines for the propagation of the electromagnetic field across the structure. This in turn develops special relationship between the impedance and phases of the different metallization pads. This in turn allows for obtaining specific frequency characteristics.

The impedance and phase may be expressed as follows:

$$Z = R + j(X_L - X_C) \tag{1}$$

$$|Z| = \sqrt{R^2 + (X_L - X_C)^2} \tag{2}$$

$$\tan\theta = \frac{X_L - X_C}{R} \tag{3}$$

where |Z| is the magnitude of the impedance of a circuit across three elements (resistor, capacitor and inductor); R is the resistance in the circuit; XL is the reactance across the inductor; $X_C$ is the reactance across the capacitor; j is $\sqrt{-1}$; and θ is the phase angle. Equations (1) to (3) show that magnitude of the impedance varies by changing capacitance (i.e. the reactance across such capacitance).

By applying known turning techniques on the variable capacitors, this antenna structure allows for varying the frequency range and the bandwidth for the antenna independently without requiring the use of completely different antenna structure. As such, the use of tunable capacitors in patch antenna 100 allows for varying the antenna's electrical length while still using the same patch antenna.

To show the effect of varying the electrical length of the antenna on the frequency response, an exemplary simulation is provided in FIGS. 2 to 15 and will be described in detail below.

Figure 2:
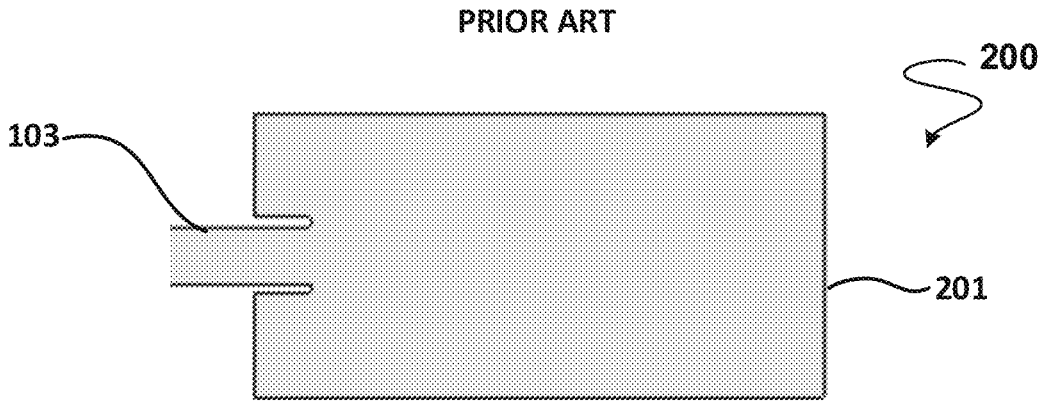
FIG. 2 shows a planner schematic view of a patch antenna with a solid metallization structure according to the prior art.
Figure 3:
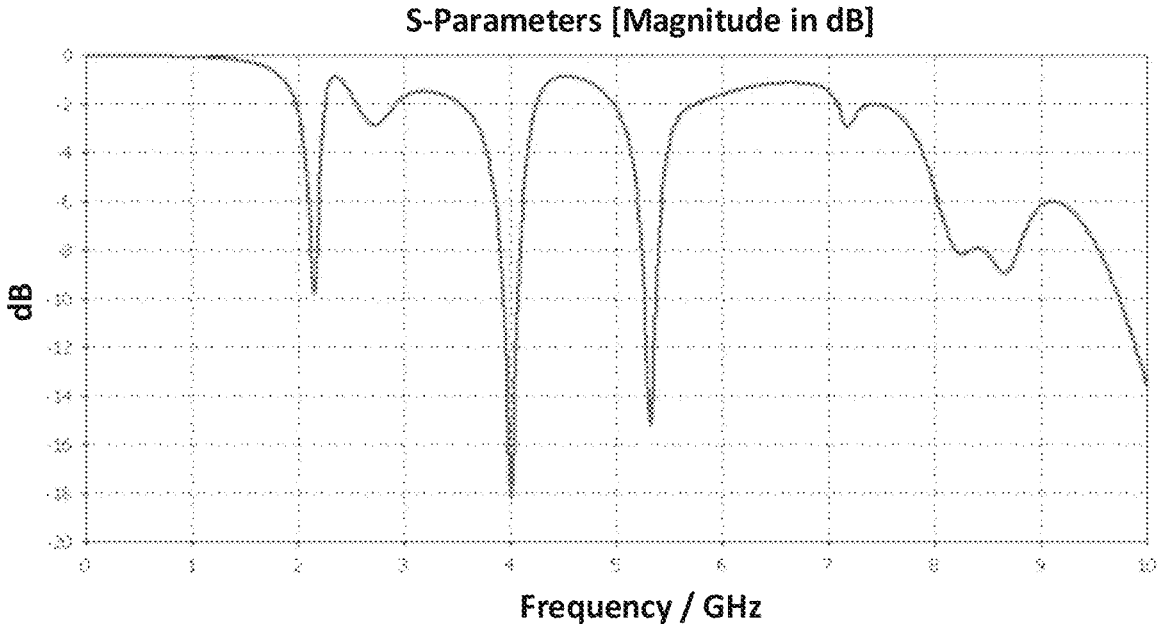
FIG. 3 shows a simulation of a frequency response for the antenna structure in FIG. 2 and where the resonant frequencies are depicted.

FIG. 2 shows a schematic planner view of a patch antenna 201 having a solid metallization structure with dimensions of 30 mm length and 15 mm width and a feed using a microtrap feed line 209. This exemplary structure is designed on FR-4 substrate (not shown). It is to be understood that all dimensions and material provided in the embodiments are exemplary and that the dimensions and/or material may vary depending on the intended use. To generate a frequency response, the antenna structure 200 was simulated at 0-10 GHz using software CST™. FIG. 3 shows the frequency response according to the simulation. In FIG. 3, four resonant frequencies are shown to be at 2.1 GHz, 4 GHz and 5.2 GHz and 8.6 GHz.

Figure 4:
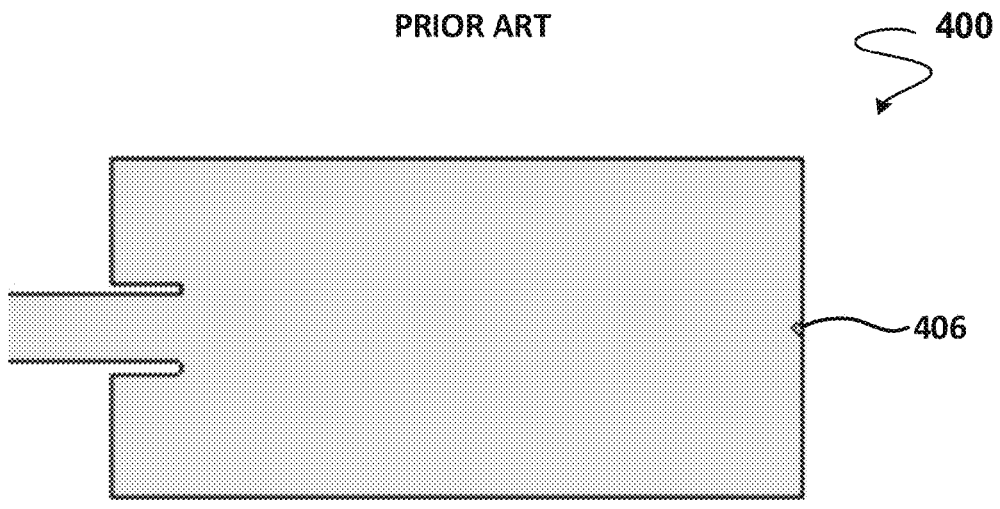
FIG. 4 shows a planner schematic view of a patch antenna in FIG. 2 with a via hole loaded in the middle of the radiation edge according to the prior art.
Figure 5:
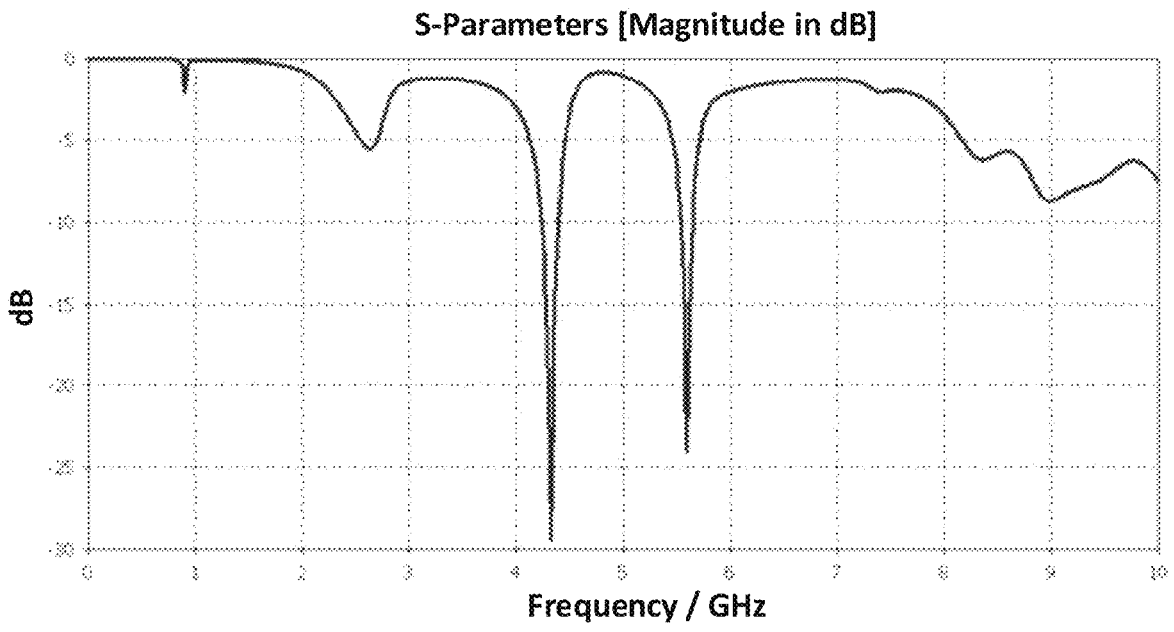
FIG. 5 shows a simulation of a frequency response for the antenna structure in FIG. 5 and where the resonant frequencies are depicted.

FIG. 4 shows a schematic planner view of the same metallization structure of FIG. 2 but with a via hole 406 loaded in the middle of the radiation edge. Under the same parameters, FIG. 5 shows a simulation of the frequency response to the patch antenna in FIG. 4. Four resonant frequencies are shown in the simulation in FIG. 5, where the $1^{st}$ to $4^{th}$ resonant frequencies are shown at 0.9 GHz, 2.6 GHz, 4.2 GHz and 5.6 GHz, respectively. A comparison between FIG. 5 and FIG. 3 shows the effect of the via hole in the patch antenna, where the resonant frequencies are now shown to have been shifted down, respectively. It is to be noted that the shift is a not linear.

Figure 6:
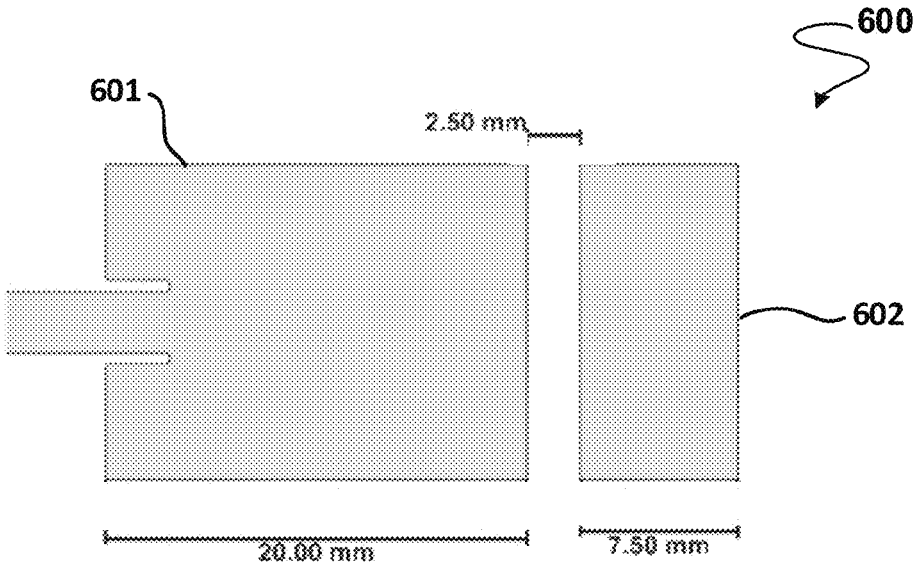
FIG. 6 shows a planner schematic view of a patch antenna divided into two unequal sections according to an embodiment of the invention.
Figure 7:
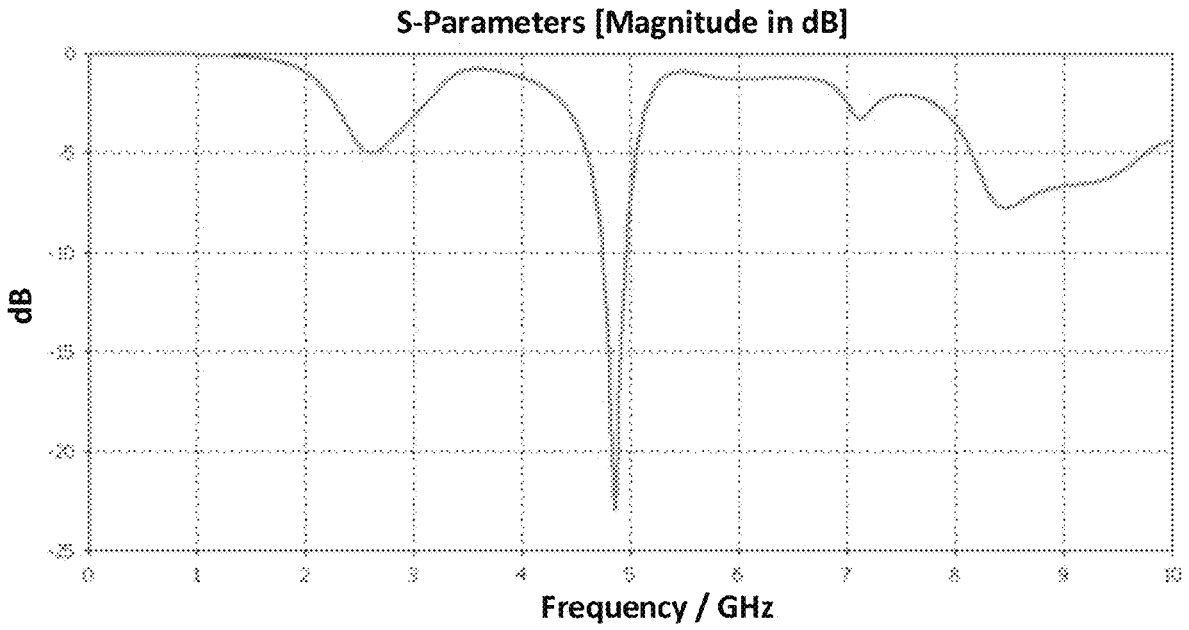
FIG. 7 shows a simulation of a frequency response for the antenna structure in FIG. 6 and where the resonant frequency is depicted.

FIG. 6 shows a schematic planner view of a patch metallization structure 600 that is identical in overall dimensions to the patch antenna of FIG. 2. However, as seen in FIG. 6, the metallization structure 600 is divided into two unequal sections: a main metallization 601 and a slot metallization 602 that is separated from the main metallization 601 by a spacing of width 2.5 mm. FIG. 7 shows the frequency response simulation under the same conditions. As shown in FIG. 7, two resonant frequencies are present at 2.6 GHz and 4.9 GHz with peaks at −5 dB and −23 dB reflection coefficient, respectively.

Figure 6A:
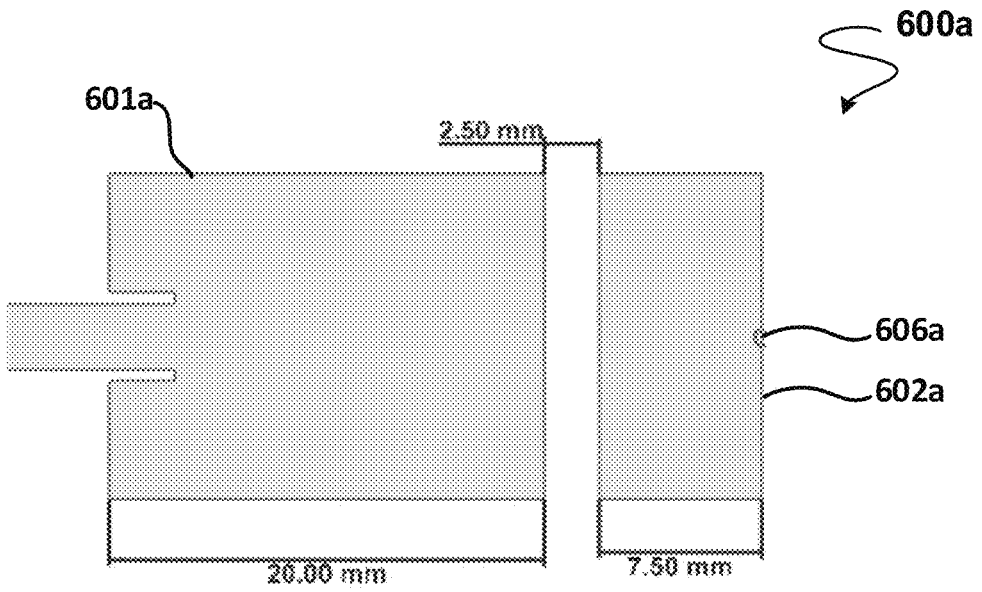
FIG. 6*a* shows a planner schematic view of the patch antenna in FIG. 6 with the addition of PIN (via hole) to the structure.
Figure 7A:
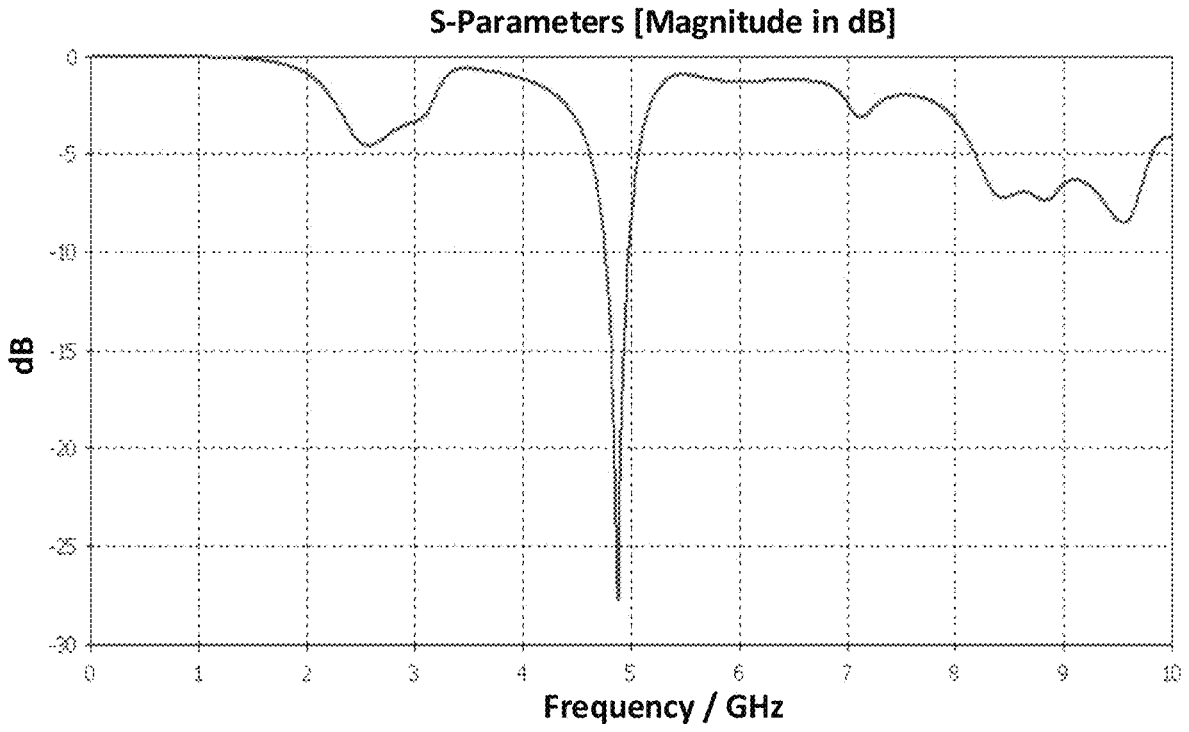
FIG. 7*a* shows a simulation of a frequency response for the antenna structure in FIG. 6*a* and where the resonant frequency is depicted.

FIG. 6*a* shows a schematic planner view of a patch metallization structure 600*a* that is identical in overall dimensions to the patch antenna of FIG. 6. However, as seen in FIG. 6*a*, the patch antenna 600*s* is shown to have via hole 606*a* loaded in the middle of the radiation edge (i.e. edge of metallization pad 602*a*), which is separated from the main metallization 601*a* by a spacing of width 2.5 mm. FIG. 7*a* shows the frequency response simulation under the same conditions. A comparison between the frequency profile in FIGS. 7 and 7*a* show that the resonant frequency response profiles are similar with no shift observed. This is expected due to the lack of capacitors in either system.

Figure 8:
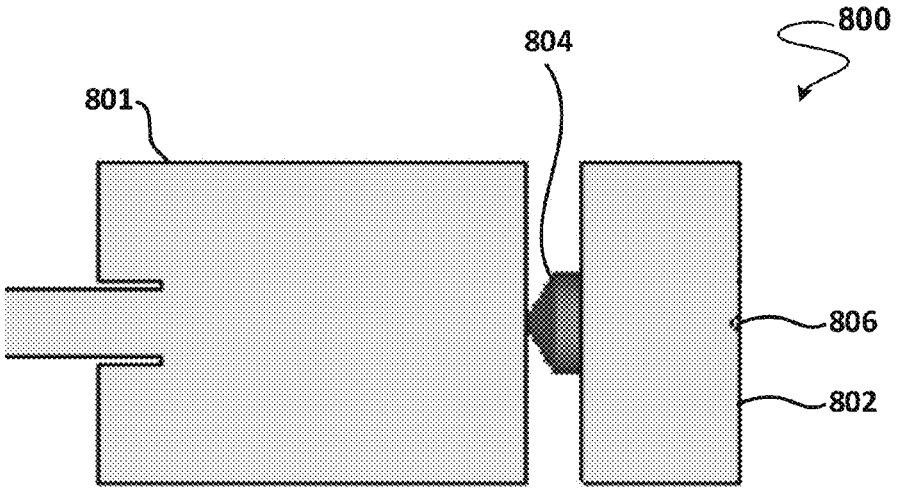
FIG. 8 shows a planner schematic view of a patch antenna divided into two unequal sections according to an embodiment of the invention, where the two sections are coupled by a capacitance.
Figure 9:
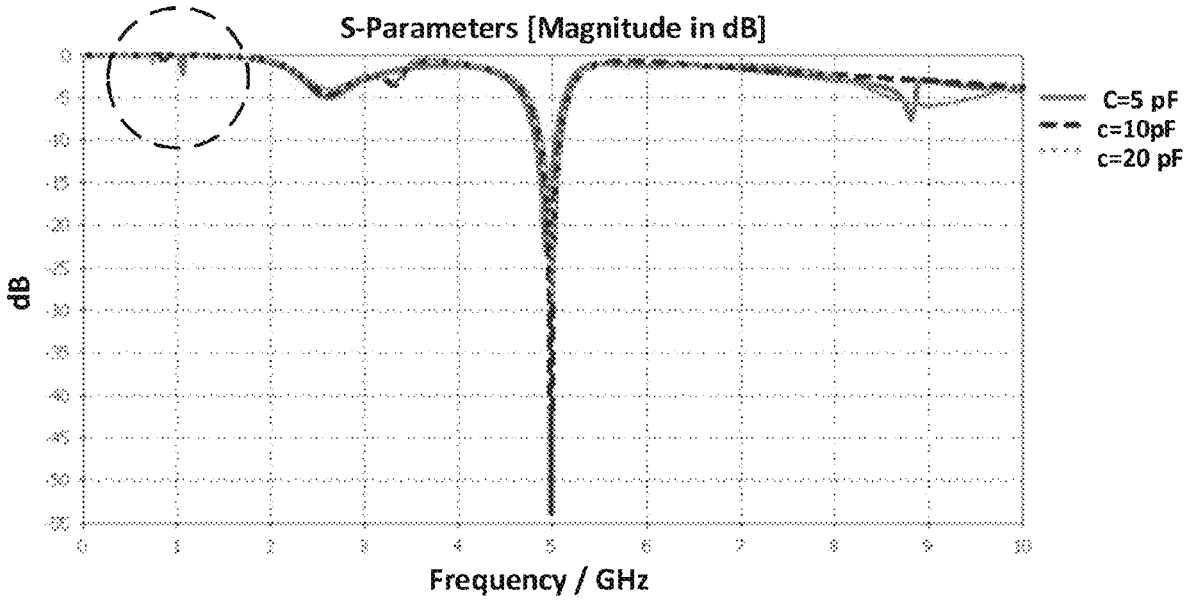
FIG. 9 shows a simulation of a frequency response for the antenna structure in FIG. 8 and where the resonant frequencies are depicted for three capacitance values.
Figure 9A:
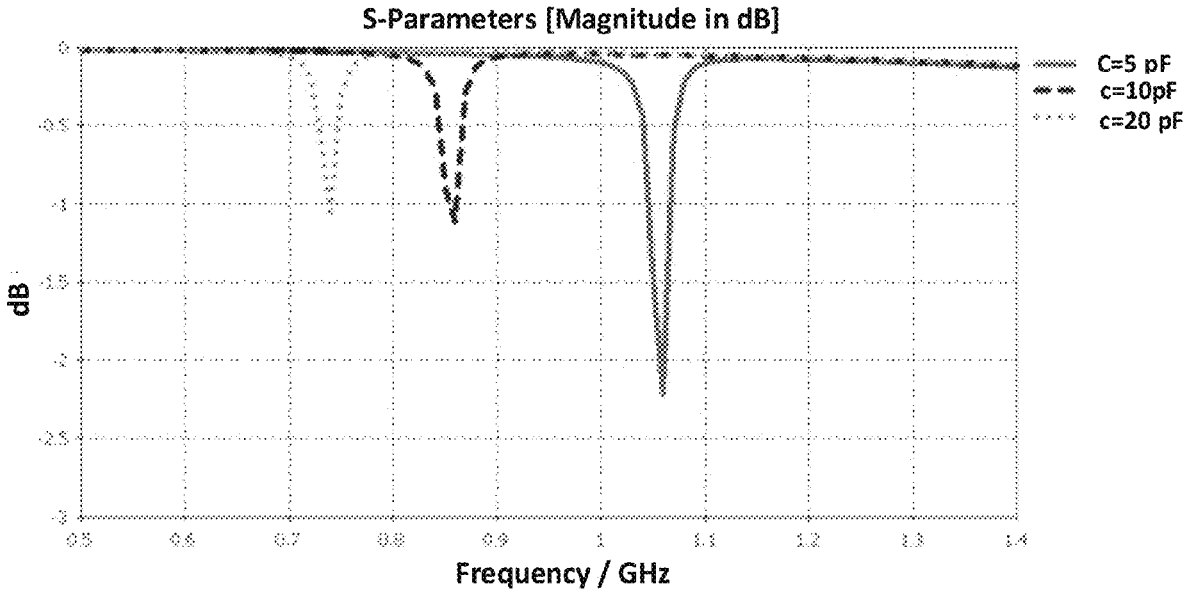
FIG. 9*a* shows an enlarged view of a section of the simulation shown in FIG. 9.

FIG. 8 shows a schematic planner view of a patch antenna metallization structure similar in dimensions to that of patch antenna 600 in FIG. 6. In FIG. 8, the patch antenna 800 is shown to have via hole 806 loaded in the middle of the radiation edge (i.e. edge of metallization pad 802). Also, in patch antenna 800, a variable capacitor 804 is shown to couple metallization pads 801 and 802. FIG. 9 shows a simulated frequency response of patch antenna 800 for three difference capacitance values, specifically: 5 pF, 10 pF and 20 pF. As shown from the circled part in FIG. 9, the value of the reflection coefficient is varied by changing the capacitance value of capacitor 804. FIG. 9*a* shows an enlarged view of the circled section of FIG. 9. As shown in FIG. 9*a*, the reflection coefficient is shown to decrease by increasing the resonant frequency.

Figure 10:
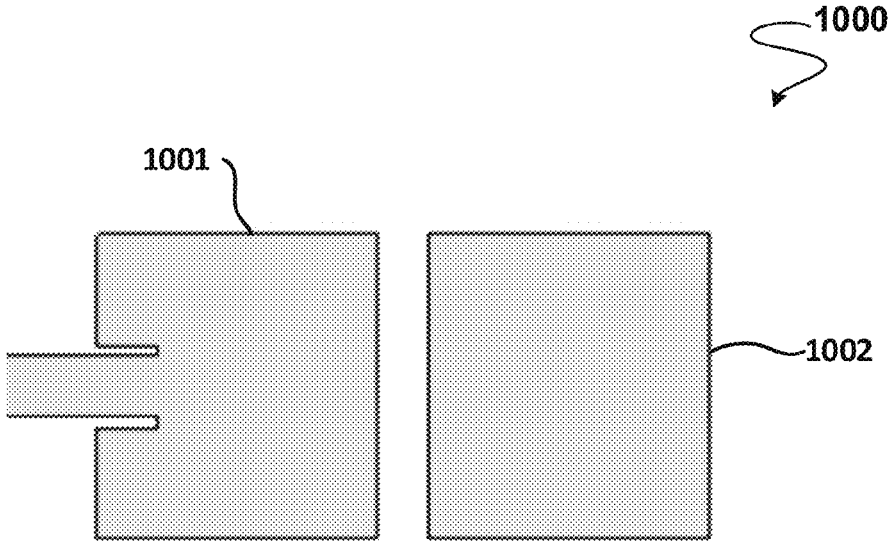
FIG. 10 shows a planner schematic view of a patch antenna divided into two equal sections according to an embodiment of the invention.
Figure 11:
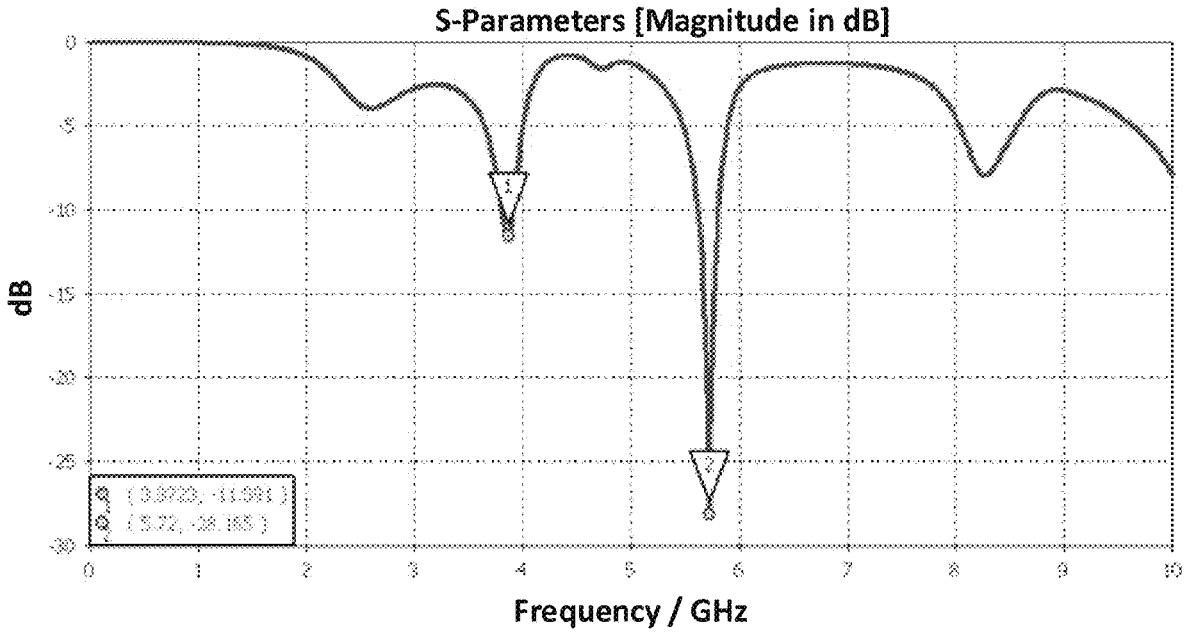
FIG. 11 shows a simulation of a frequency response for the antenna structure in FIG. 10 and where the resonant frequencies are depicted.

FIG. 10 shows a schematic planner view of a patch antenna metallization 1000 that is identical in overall dimensions to the patch antenna of FIG. 2. However, as seen in FIG. 10, the metallization structure 1000 is divided into two equal sections: a main metallization 1001 and a slot metallization 1002 that is separated from the main metallization 1001 by a spacing of width 2.5 mm. FIG. 11 shows the frequency response simulation under the same conditions as the other simulations. As shown in FIG. 11, two resonant frequencies are present at 3.87 GHz and 5.72 GHz. By comparing the frequency response in FIGS. 11 and 3, it is observed that the resonant frequency is varied by changing the length of the main metallization pad and slot metallization.

Figure 12:
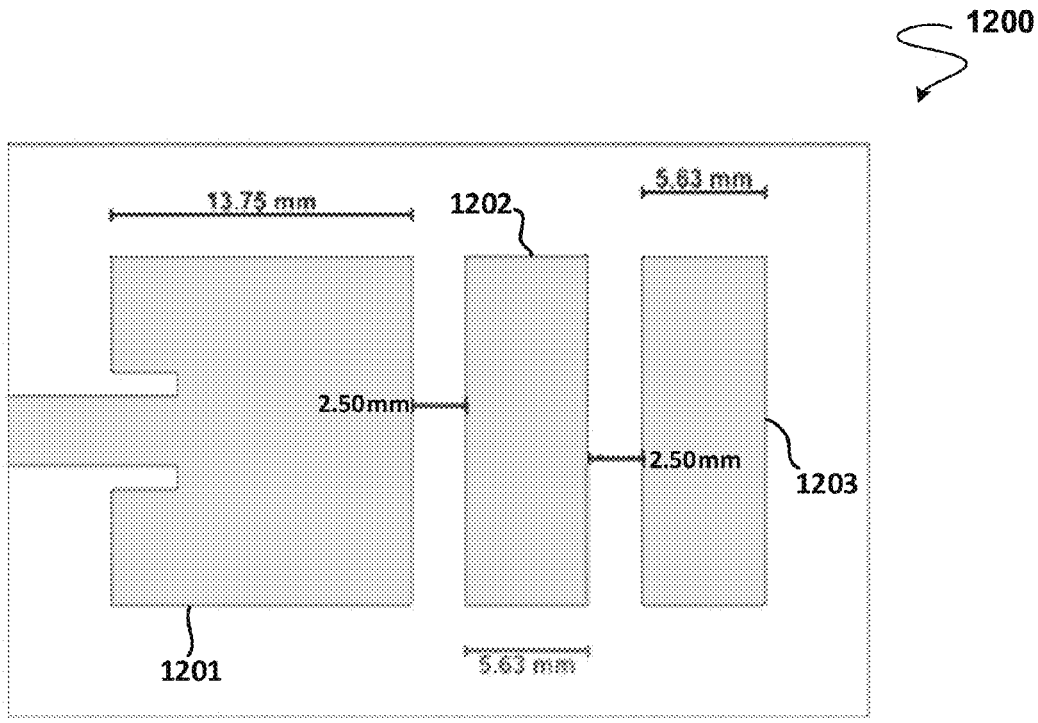
FIG. 12 shows a planner schematic view of a patch antenna divided into three sections according to an embodiment of the invention.
Figure 13:
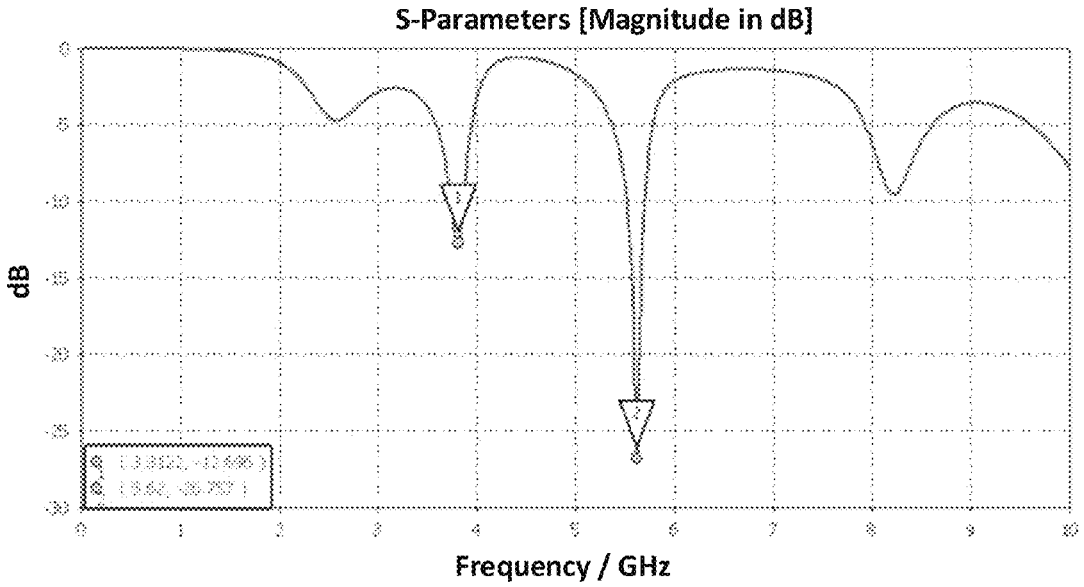
FIG. 13 shows a simulation of a frequency response for the antenna structure in FIG. 12 and where the resonant frequencies are depicted.

FIG. 12 shows a schematic planner view of a patch antenna metallization 1200 that is identical in overall dimensions to the patch antenna of FIG. 10 (i.e. 30 mm in length). However, in FIG. 12, the metallization structure is divided into three pads: a main pad 1201, a second pad 1202 and a third pad 1203, where pads 1202 and 1203 are of identical dimensions, pad 1201 is longer in length than either of pads 1202 and 1203 and where all pads are spaced apart by 2.5 mm. It is to be understood that the length and spacing is only exemplary and that other dimensions are envisioned to be covered under the scope of this invention. FIG. 13 shows the frequency response simulation under the same conditions as the other simulations. As shown in FIG. 13, two resonant frequencies are present at 3.81 GHz and 5.62 GHz. A comparison between FIG. 10 and FIG. 13 shows that the frequency shift is minimal between the 1 slot and 2 slot metallization structures. It is noted that pads 1001 and 1201 are of the same size and material. Also, the spacing between each of pads 1001 and 1201 and pads 1002 and 1202, respectively, and hence the coupling is the same. As such, based on these parameters, the same reflection back is experienced in both embodiments; hence minimal change is observed in the frequency response. Further, because pad 1203 has no short PIN, the wave does not reflect back, thereby resulting in minimal change in the frequency response.

Therefore, it is observed from the above simulations, and specifically from FIG. 9, that it is possible to change the resonant frequency of a patch antenna by dividing the metallization into separate sections and coupling them with a tunable variable capacitor. This also shows that tunable capacitors may be used to change electrical length of the patch antenna and hence its frequency response without the need to completely change to a different antenna structure.

Figure 14:
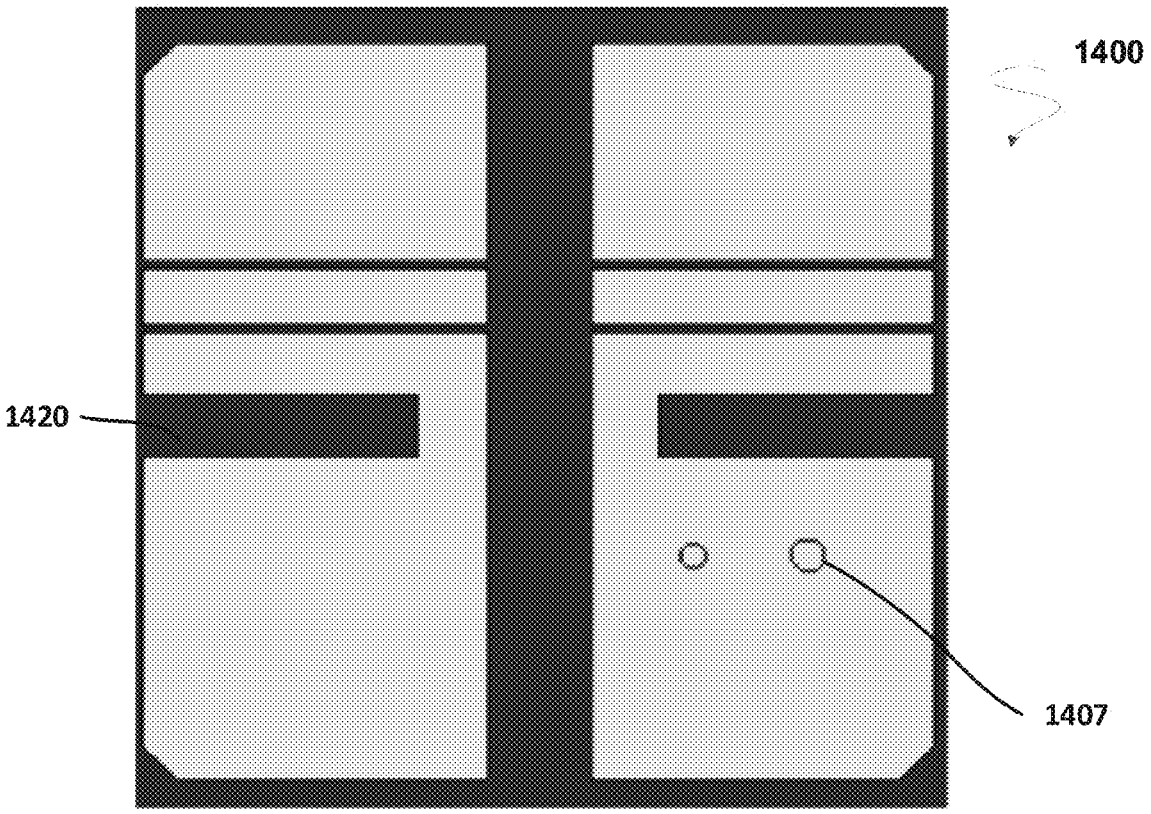
FIG. 14 shows a planner schematic view of the antenna structure in FIG. 1 but with the capacitors not loaded.
Figure 15:
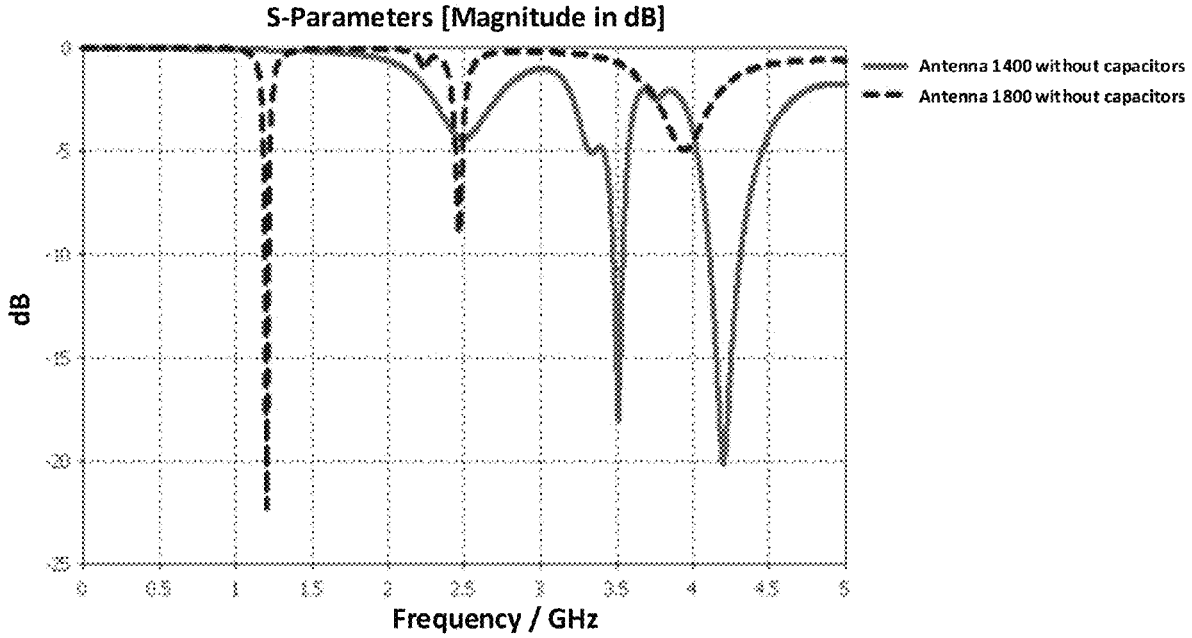
FIG. 15 shows a simulation of a frequency response for the antenna structures in FIG. 13 and FIG. 18, where the resonant frequencies are depicted.

FIG. 14 shows a schematic planner view of a patch antenna structure identical to that of FIG. 1. However, in FIG. 14, the capacitors are not used to couple the metallization pads. FR-4 is used as a substrate 1420 and the structure is fed using coaxial feel line into input port 107. FIG. 15 shows a simulation of the frequency response, where the resonant frequency is depicted in solid line for the antenna structure in FIG. 14. By knowing the capacitance and current, resonance and bandwidth may be obtained. The relationship between the capacitor value and the frequency may be expressed as:

$$f = \frac{1}{\sqrt{C_{eff} L_{eff}}}; \tag{4}$$

where $L_{eff}$ is the effective inductance value and $C_{eff}$ is the effective capacitance value.

Figure 14A:
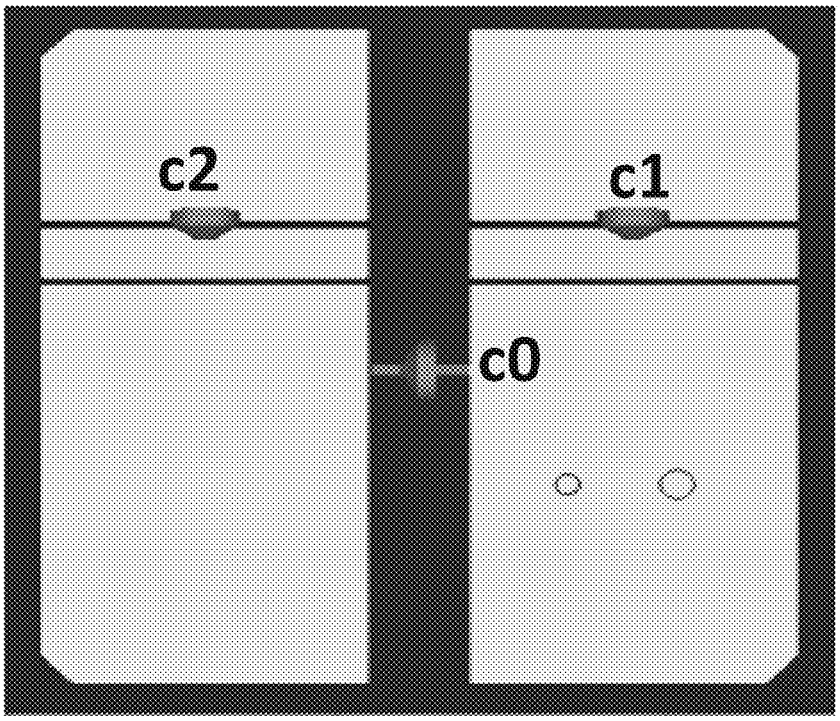
FIG. 14*a* shows a planner schematic view of the antenna structure of FIG. 1 but without a DC blocking capacitor or a gap in the main metallization pad.

In the antenna structure provided in the exemplary embodiment of FIG. 1, pad 101 is shown to have a partial gap indicated by an arrow in FIG. 14. Changing the position, thickness or length of this gap, while maintaining all other parameters the same, causes an effect on the frequency response of the antenna structure. This is shown in FIGS. 14*a* to 141 and is explained below. Specifically, FIG. 14*a* shows a schematic planner view of a patch antenna structure similar to that of FIG. 1. However, in FIG. 14*a*, the pad analogous to pad 101 (also referenced herein as the main pad) lacks the gap indicated in FIG. 1. Additionally, the DC blocking capacitor is not included in FIG. 14*a*. For the sake of comparison and to eliminate any variance that may be due to the DC blocking capacitor, the antenna structure of FIG. 1 has been reproduced in FIG. 14*b* but without the DC blocking capacitor. FIG. 14*c* shows a simulation of the frequency response for the two antennas in FIGS. 14*a* and 14*b*, where c1 and c2 are set to be of same values between the two antenna structures. FIG. 14*c* shows that by introducing the gap in main pad, the frequency response is shifted and its magnitude is changed.

Figure 14B:
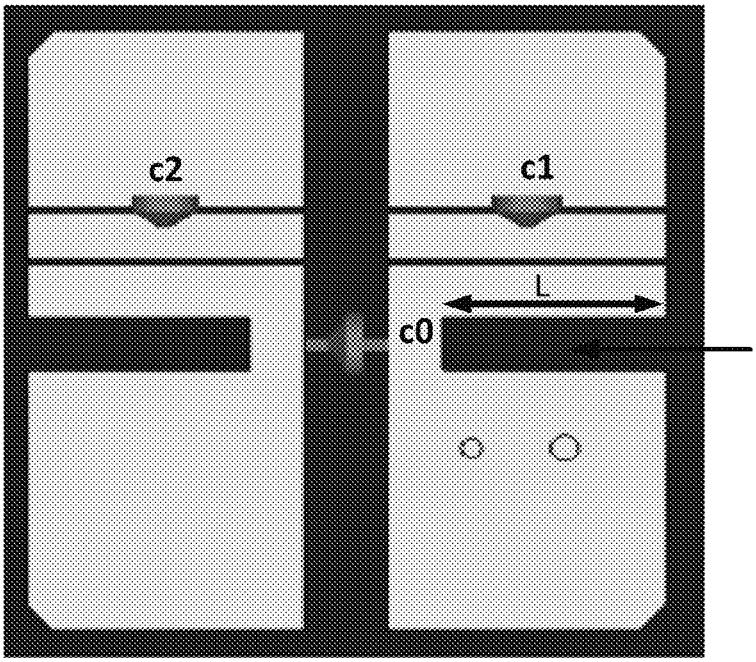
FIG. 14*b* shows a planner schematic view of the antenna structure of FIG. 1 but without a DC blocking capacitor.
Figure 14C:
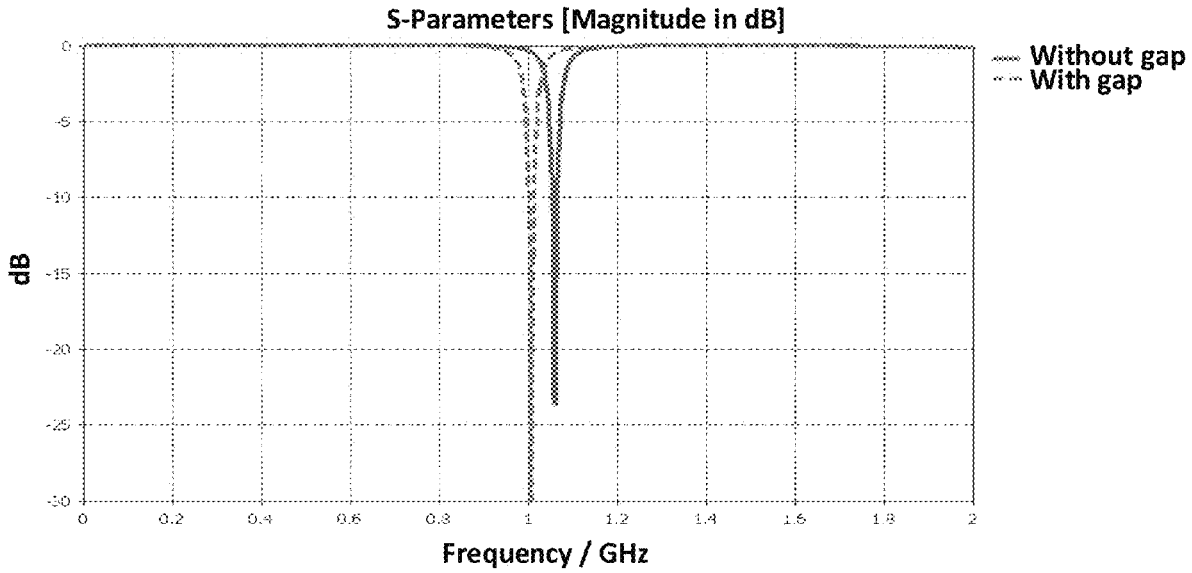
FIG. 14*c* shows a simulation of a frequency response for the antenna structures in FIG. 14*a* and FIG. 14*b*, where the resonant frequencies are depicted.
Figure 14D:
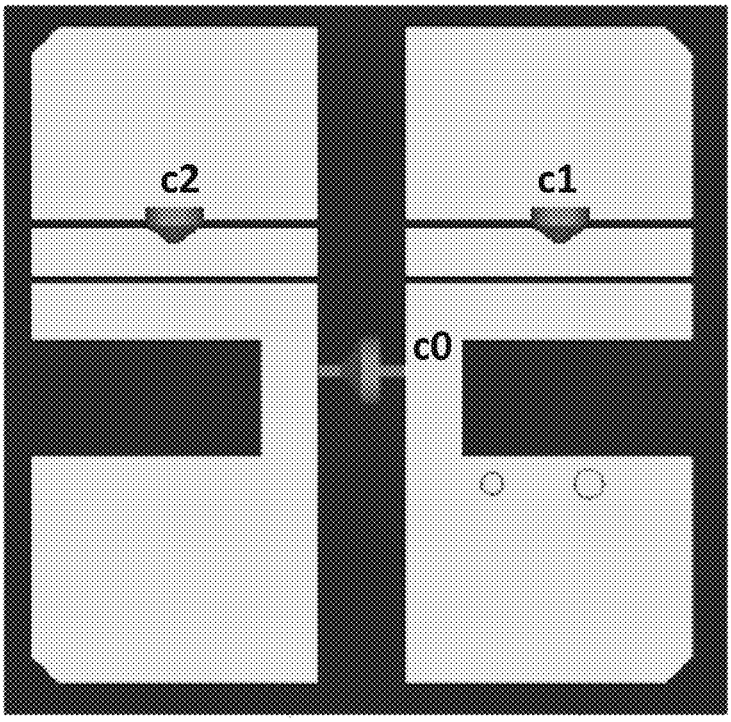
FIGS. 14*d* and 14*e* show a planner schematic view of the antenna structure of FIG. 14*b* with the gap width doubled and halved, respectively.
Figure 14E:
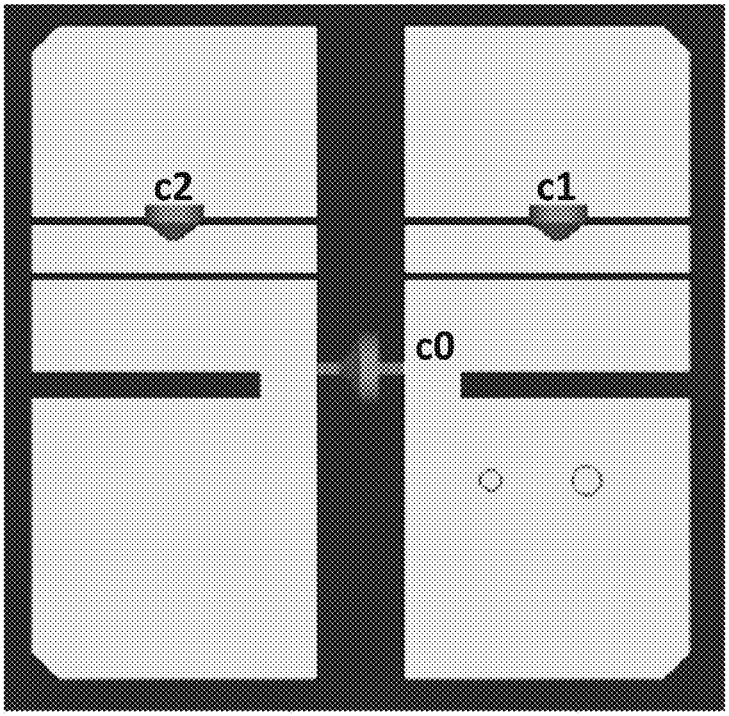
Figure 14F:
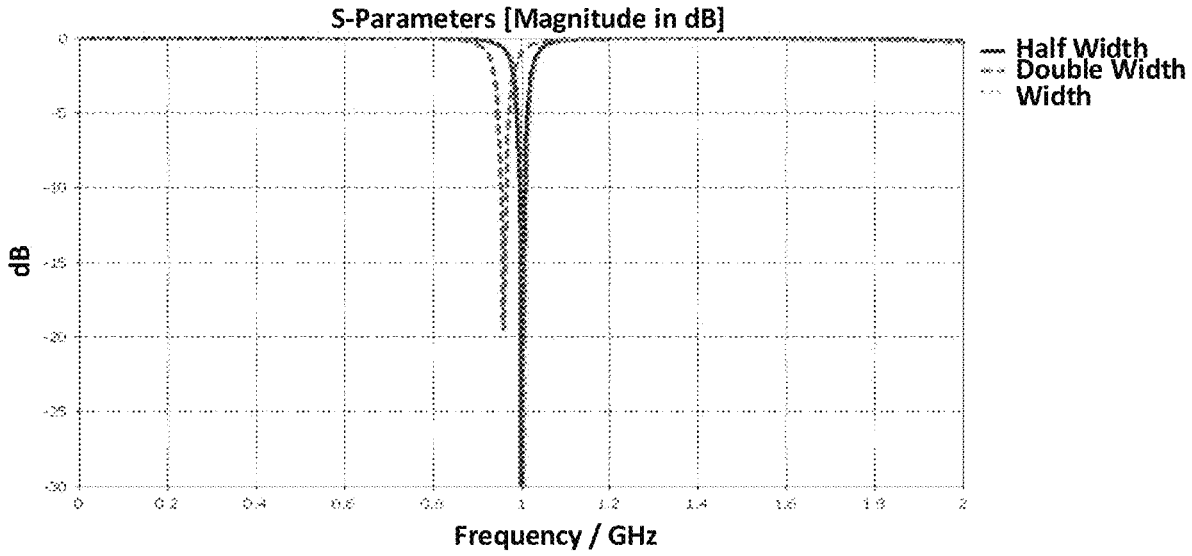
FIG. 14*f* shows a simulation of a frequency response for the antenna structures in FIG. 14*b*, FIG. 14*d* and FIG. 14*e*, where the resonant frequencies are depicted.

FIGS. 14*d* and 14*e* show schematic planner views of a patch antenna structure similar to that of FIG. 14*b* but where the width of the gap in the main pad is doubled in FIG. 14*d* and halved in FIG. 14*e*. FIG. 14*f* shows a simulation of the frequency response for the three antennas in FIGS. 14*b*, 14*d* and 14*e*, where c1 and c2 are set to be of same values between the two antenna structures. As shown in FIG. 14*f*, the resonant frequency is shifted down and reduced in amplitude when the gap is doubled in size. Minimum effect is observed on the frequency response when the gap is halved. In addition to the gap width affecting the coupling (as discussed above), it also allows for determining the ratio of the two parts in pad 101 separated by the gap, which also contributes to the frequency response change.

Figure 14G:
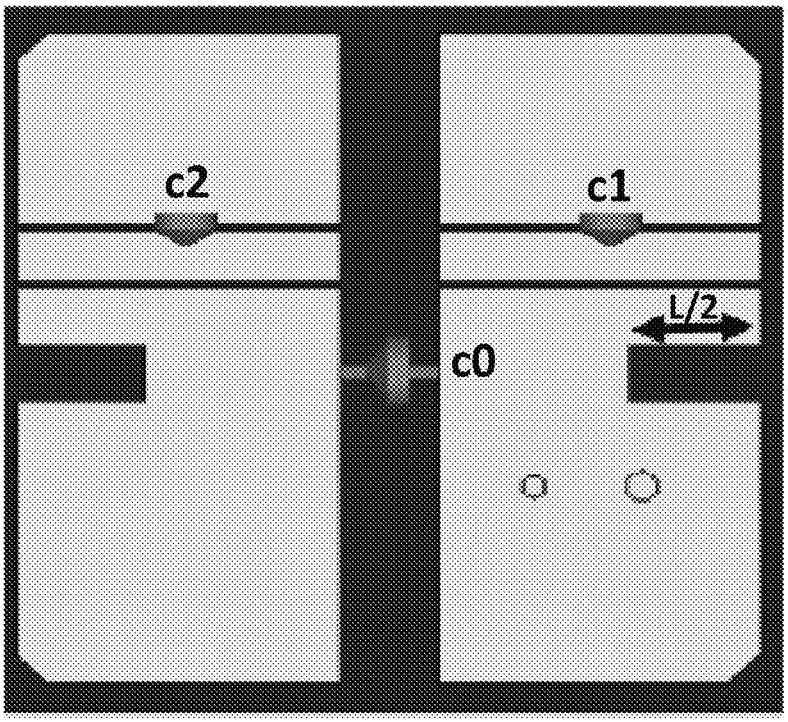
FIGS. 14*g* and 14*h* show a planner schematic view of the antenna structure of FIG. 14*b* with the gap length being ½ L and ¾ L, respectively, where L is the length of the gap in FIG. 14*b*.
Figure 14H:
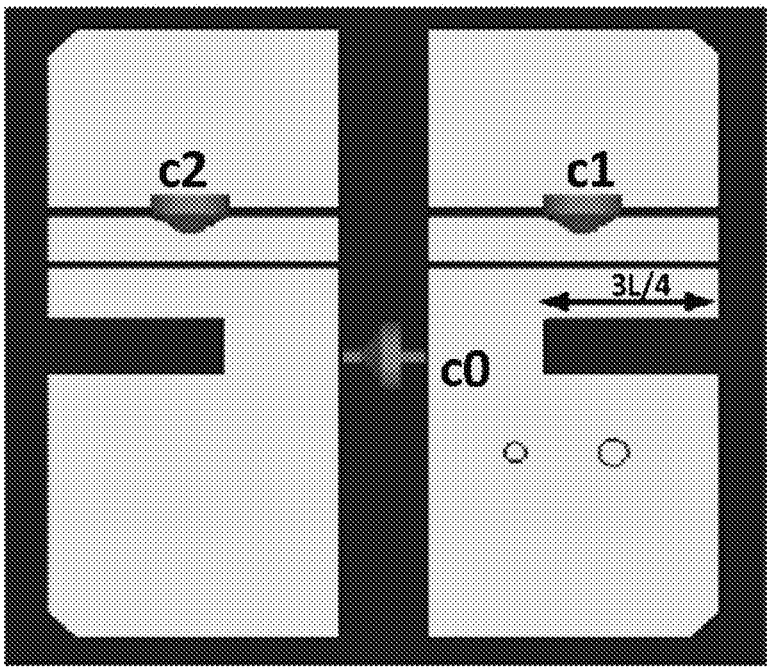
Figure 14I:
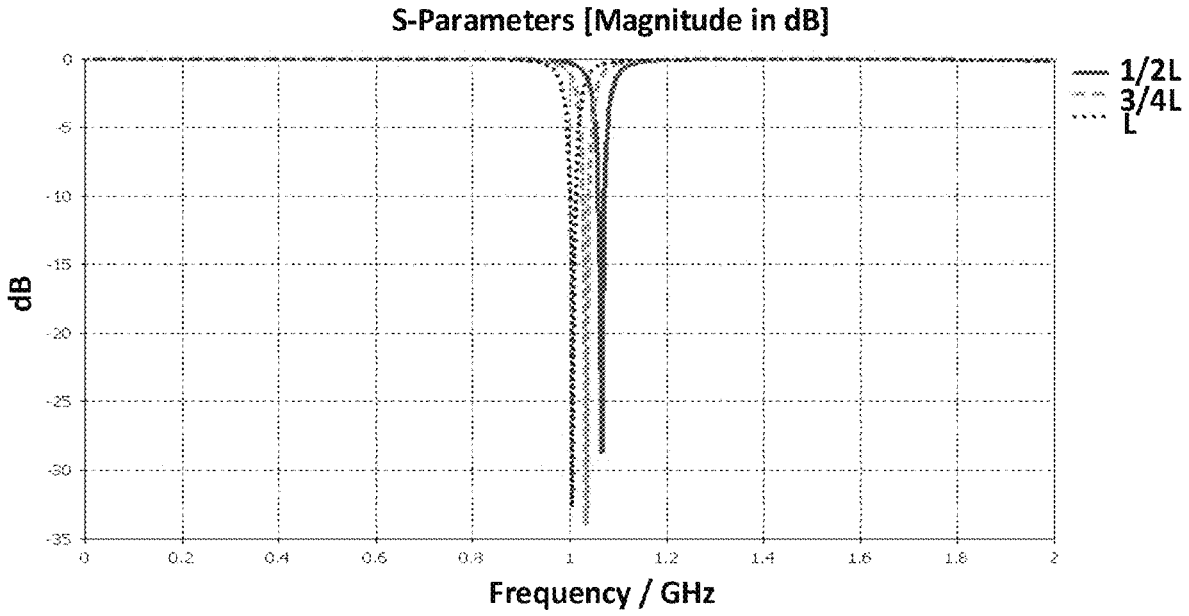
FIG. 14*i* shows a simulation of a frequency response for the antenna structures in FIG. 14*b*, FIG. 14*g* and FIG. 14*h*, where the resonant frequencies are depicted.

Varying the length of the gap in the main pad also affect the frequency response of the antenna structure. The length of the gap in FIG. 14*b* is indicated by the double sided arrow and is represented by L. FIGS. 14*g* and 14*h* represent the antenna structure in FIG. 14*b* but where in FIG. 14*g*, the length of the gap is ½ L and in FIG. 14*h*, the length of the gap is ¾ L. FIG. 14*i* shows a simulation of the frequency response for the three antennas in FIGS. 14*b*, 14*g* and 14*h*, where c1 and c2 are set to be of same values among the three antenna structures. As shown in FIG. 14*i*, varying the length of the gap in the main metallization pad shift the resonant frequency and varies its amplitude.

Figure 14J:
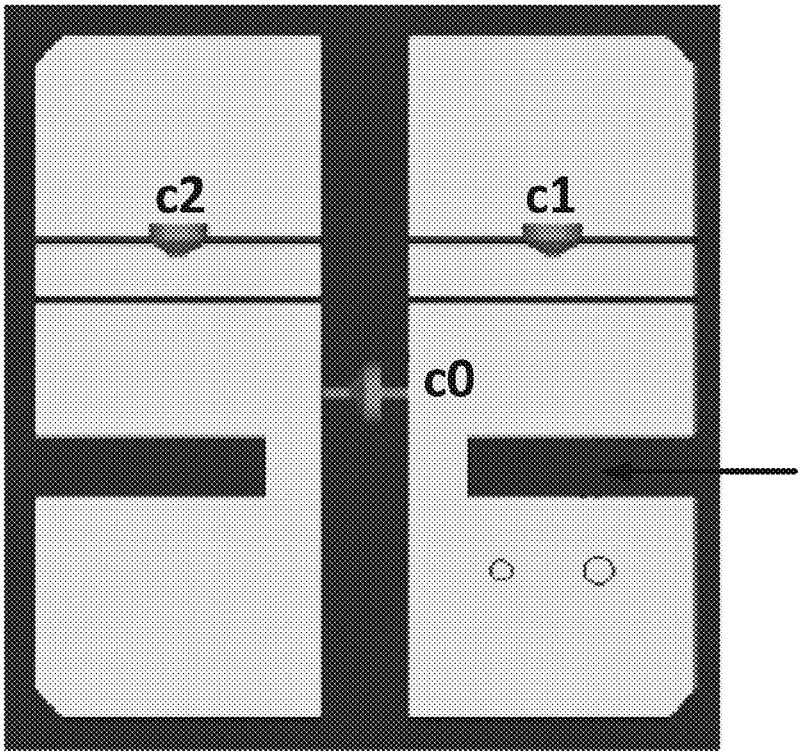
FIGS. 14*j* and 14*k* show a planner schematic view of the antenna structure of FIG. 14*b* with the gap position different such that the ratio of the width of the top section and the bottom section increase, respectively in comparison to the ratio shown in FIG. 14*b*.
Figure 14K:
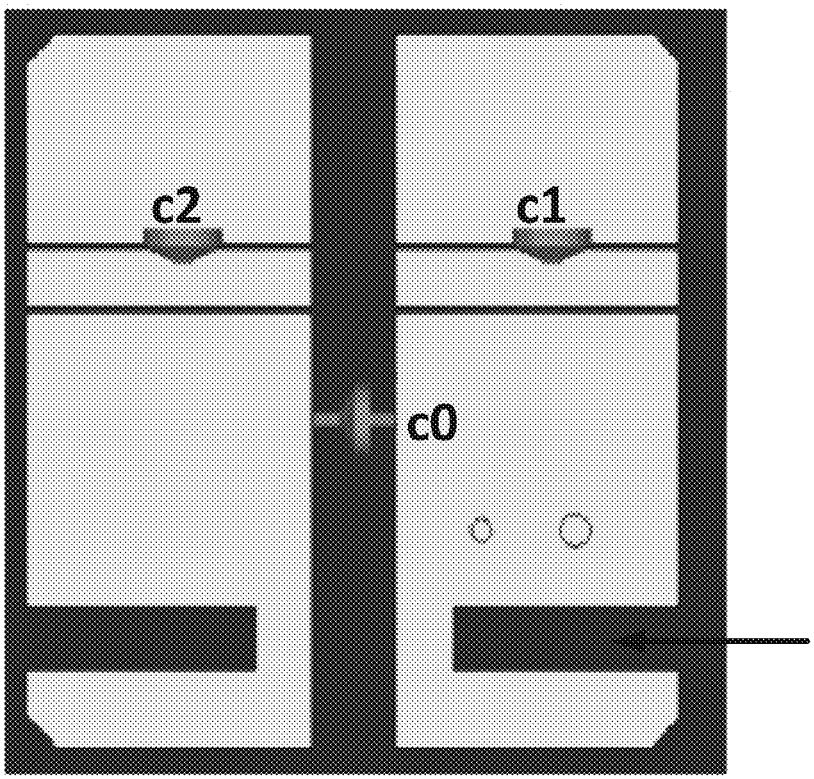
Figure 14I:
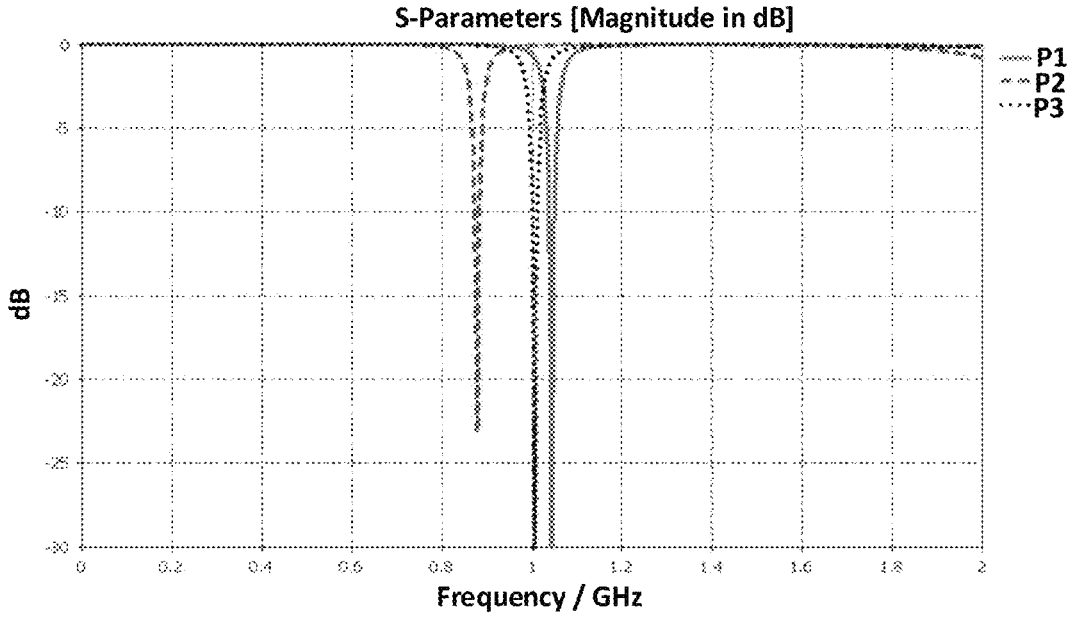

The gap in FIG. 1 and FIG. 14*b* divides the main metallization pad into two slots that are co-planar and of the same orientation. The two slots are connected to each other by a metallization section at one edge causing the gap to be pointing outward from the main metallization pad. The presence of the gap contributes to the overall shape of the antenna, which as described in a previous section, provides guidelines for the propagation of the electromagnetic field across the antenna structure. In FIG. 14*b*, the two slots are shown to be of different width with the ratio of the small slot to the big one being small. In FIG. 14*j* and FIG. 14*k*, the position of the gap is changed so that the ratio of the width of the two slots created by the gap is changed. Specifically, in FIG. 14*j*, the ratio of the small slot to the big slot is increased. In FIG. 14*k*, the ratio is increased further. FIG. 14*l* shows a simulation of the frequency response for the three antennas in FIGS. 14*b*, 14*j* and 14*k*, where c1 and c2 are set to be of same values among the three antenna structures and where the ratio of the top slot to the bottom slot is P1, P2, and P3, representing FIGS. 14*b*, 14*j* and 14*k*, respectively. As shown in FIG. 14*l*, increasing the ratio width between the two metallization slots, causes the resonant frequency to shift down and reduce in amplitude. Increasing this ratio even further so that, in one orientation as shown in the figures, the top slot is shown to have a bigger width than the bottom slot, causes the resonant frequency to shift up and increase in amplitude.

Returning to FIG. 1, three capacitors are shown in patch antenna 100. While a single capacitor may be used to vary the resonant frequency of the patch antenna, a single capacitor coupling will allow for the frequency and the bandwidth to be changed simultaneously and dependently. However, with more capacitor couplings, the frequency and bandwidth may be changed independently and simultaneously. It is to be understood that a minimum of three variable capacitors will be required to establish independent simultaneous tunability in frequency and bandwidth. The number of coupling capacitors will increase the degree of freedom to alter the structure frequency response, which in turn allows for better control of frequency and bandwidth.

To achieve a predetermined frequency and bandwidth, the variable capacitances may be configured (i.e. tuned/adjusted) by a control system (not shown in FIG. 1). The control system may comprise a general processor configured to use the desired frequency and bandwidth as input and based on relationships between capacitance, frequency and bandwidth as will be described below, to produce the three capacitance values required to achieve the desired frequency and bandwidth in simulation or reality. A lookup table may be accessible by the processor, where the lookup table may comprise specific capacitance values for capacitors 104*a*, 104*b* and 108 required to set a specific bandwidth and frequency to the antenna structure. The lookup table may be initially populated by the processor for different sets of capacitance values corresponding to desired frequencies and bandwidths. The lookup table may later be updated with new capacitance values and their corresponding frequency and bandwidth values, if such values are not found by the processor to already exist in the lookup table. The lookup table may be stored in a memory storage device that may be either integral or external to the processor.

A regression method was used to construct the relationship between the frequency (Fr) and the bandwidth (BW) as input and capacitors $C_0$, $C_1$ and $C_2$ (representing 108, 104*a* and 104*b*, respectively) as outputs, where:

$$C_0=12.33+154.5*BW-10.92*Fr$$

$$C_1=5-2.745e-13*BW+6.179e-15*Fr$$

$$C_2=5-5.311e-13*BW+1.084e-14*Fr$$

To construct this relationship, the following steps were followed:

1) the minimum, mid and maximum values for the all capacitors are determined. (min=1 pF, mid=5 pF and max 10 pF);
2) the antenna structures is simulated for all-possible combinations of the three capacitances;
3) the out of the simulated reflection coefficient, the center frequency or resonance along with the 3 dB bandwidth are recorded; and
4) a regressing method is used to develop a link between $C_0$, $C_1$ and $C_2$ with the desired frequency and bandwidth.

The above regression method was validated and the process showed that the error was negligible. The following process is used for the validation:

1) A specific (pre-determined) bandwidth and frequency is given;
2) the capacitance values are computed for the pre-determined frequency and bandwidth values;
3) the antenna structure is simulated for these values; and
4) the frequency and Bandwidth are extracted and compared for the simulated and pre-determined values.

Therefore, according to the current invention, multiple frequency characteristics may be achieved using a single antenna structure by varying the electrical length of the antenna structure without changing the antenna itself. Matching circuit of various designs known in the art may be required to overcome the signal degradation when the antenna frequency characteristics are shifted. The source of degradation may be attributed to the fact that the antenna is initially designed for specific frequency and bandwidth and having specific electrical length and coupling. Altering this length and coupling will cause the electrical filed to change accordingly. Therefore, the reflecting signal will change due to this change and experience degradation. The effective inductance and capacitance of the pattern with tuning action results in stronger electrical coupling, which in turn enhances the matching and overcomes the losses.

Figure 16:
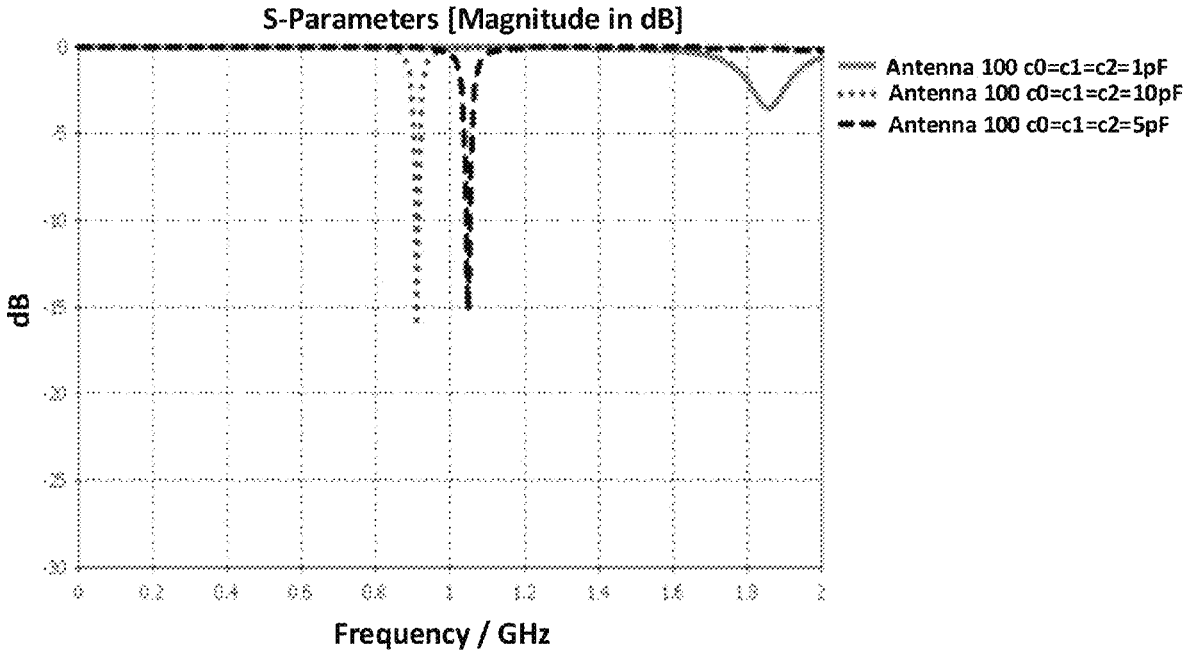
FIG. 16 shows a simulation of a frequency response for the antenna structure in FIG. 1 and where the resonant frequencies are depicted for three capacitance values.
Figure 17:
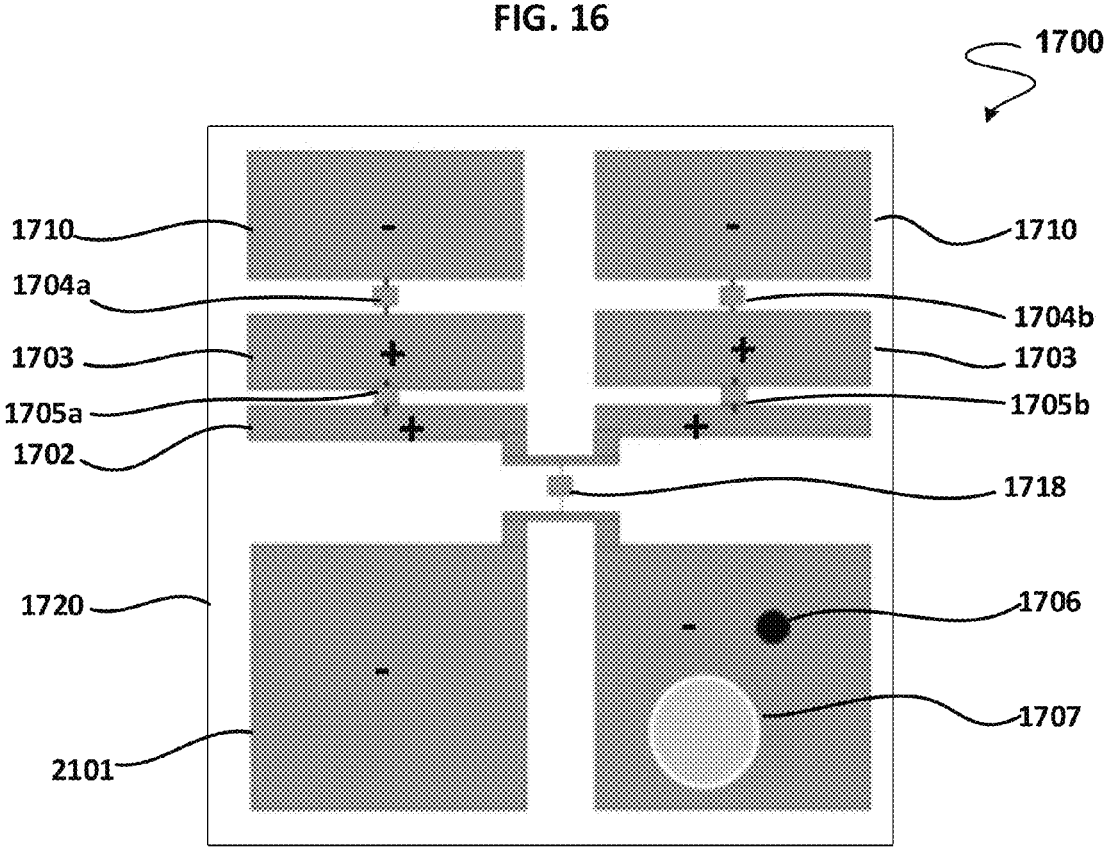
FIG. 17 shows a planner schematic view of an antenna structure allowing for agile frequency tuning according to another embodiment of the invention.

FIG. 16 shows a simulation of the frequency response to patch antenna 1700 in FIG. 17 and subject to the same condition as previous simulations. The resonant frequencies are shown to vary with varying capacitance. In FIG. 16, the simulation is run by setting all tunable variable capacitors to be equal and with varying the capacitance value to 1 pF, 5 pF and 10 pF for each simulation. FIG. 16 shows how tuning the capacitance shifts and varies the resonant frequencies for patch antenna 100.

Figure 18:
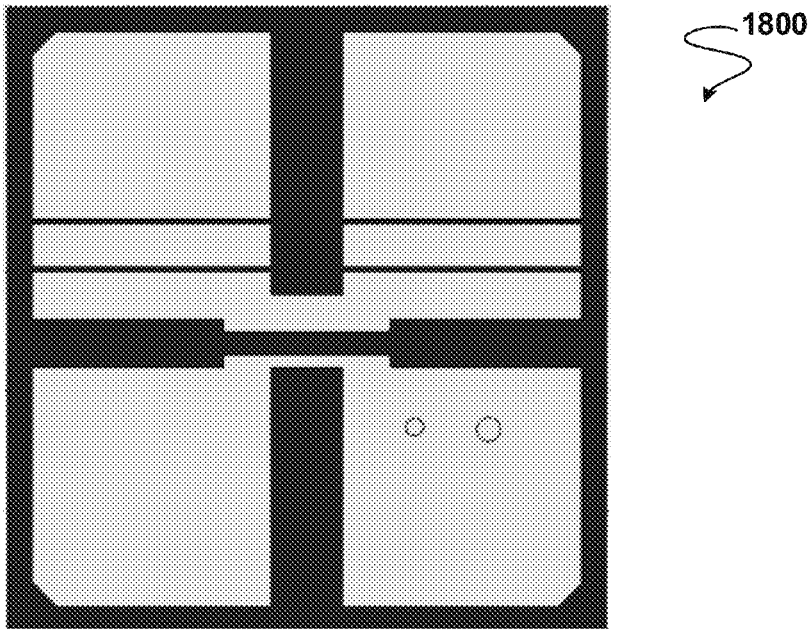
FIG. 18 shows a planner schematic view of the antenna structure in FIG. 17 but with the capacitors not loaded.

Referring back to FIG. 1, each of the two identical sections of the patch antenna is shown to have three metallization pads. However, it is to be understood that the number of metallization slots may vary according to different embodiments of the invention. For example. FIG. 17 shows a schematic planner view of a patch antenna structure 1700, in which metallization pads are provided in the patch antenna. By dividing the metallization sheet into four pads with three capacitors coupling, potential difference is created between the pads not connected by capacitors, which affects the vertical capacitance 1708 and creates DC bias overlap, which will cause instability and changes the DC bias voltage setting, due to floating DC voltage across the pads. To prevent this, the blocking capacitors 1705*a*/1705*b* are introduced between metallization pads 1702 and 1703, in comparison to pads 101 and 102 in FIG. 1. FIG. 18 shows a schematic planner view of a patch antenna identical to that of FIG. 17 but without the capacitors loaded.

Figure 19:
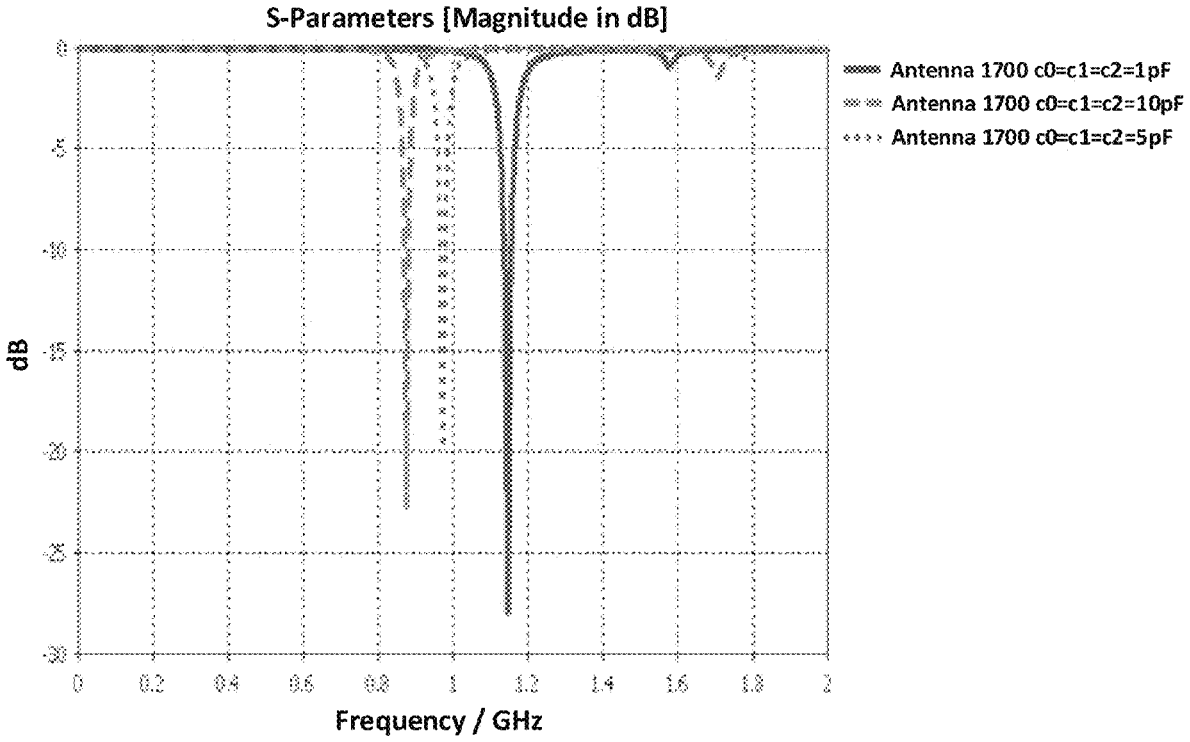
FIG. 19 shows a simulation of a frequency response for the antenna structure in FIG. 17 and where the resonant frequencies are depicted for three capacitance values.

FIG. 15 shows a simulation of the frequency response, where the resonant frequency is depicted in dashed line for the antenna structure in FIG. 18. FIG. 19 shows a simulation of the frequency response to patch antenna 1700 in FIG. 17 and subject to the same condition as previous simulations. The resonant frequencies are shown to vary with varying capacitance. In FIG. 19, the simulation is run by setting all tunable variable capacitors to be equal and with varying the capacitance value to 1 pF, 5 pF and 10 pF for each simulation. FIG. 19 shows how tuning the capacitance shifts and varies the resonant frequencies for patch antenna 100

In the embodiment shown in FIG. 1, the metallization pads 102 and 103 are shown to be horizontally aligned with pad 101 and connected in series through coupling capacitor 104*a*/104*b* and DC blocking capacitor 105*a*/105*b*. However, in other embodiments, the geometric and electrical orientation may be different, as seen in FIG. 20.

Figure 20:
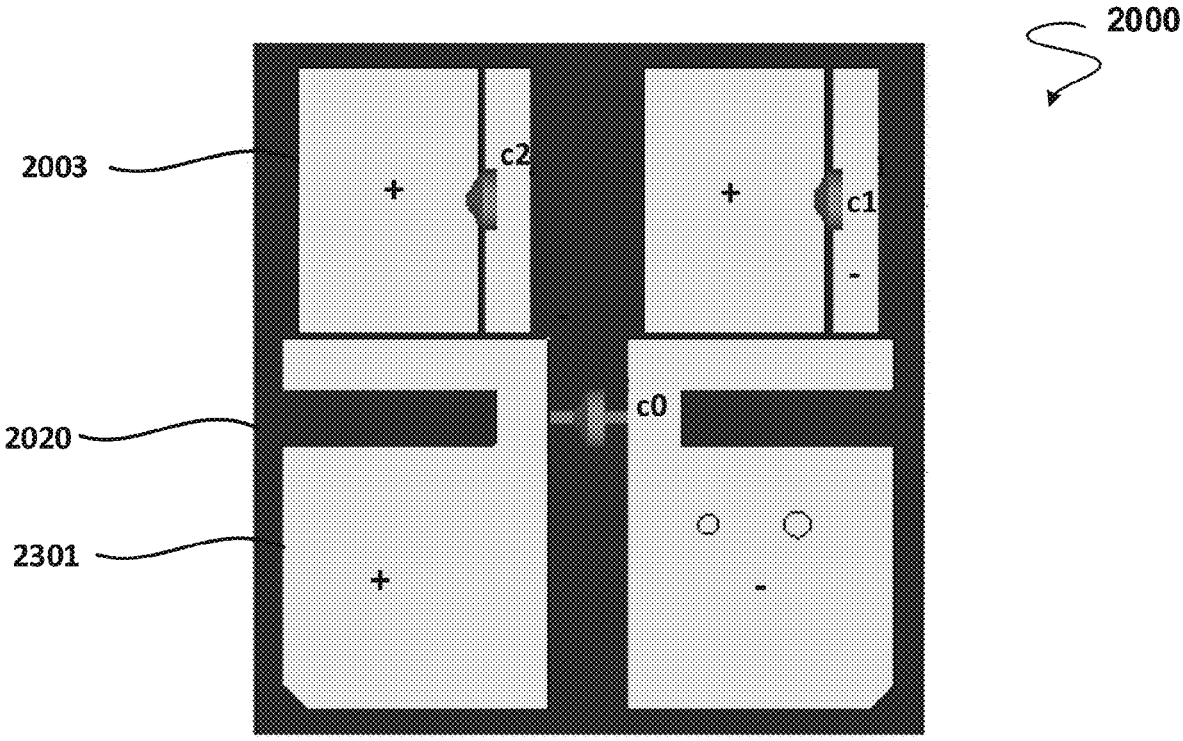
FIG. 20 shows a planner schematic view of an antenna structure allowing for agile frequency tuning according to another embodiment of the invention.
Figure 21:
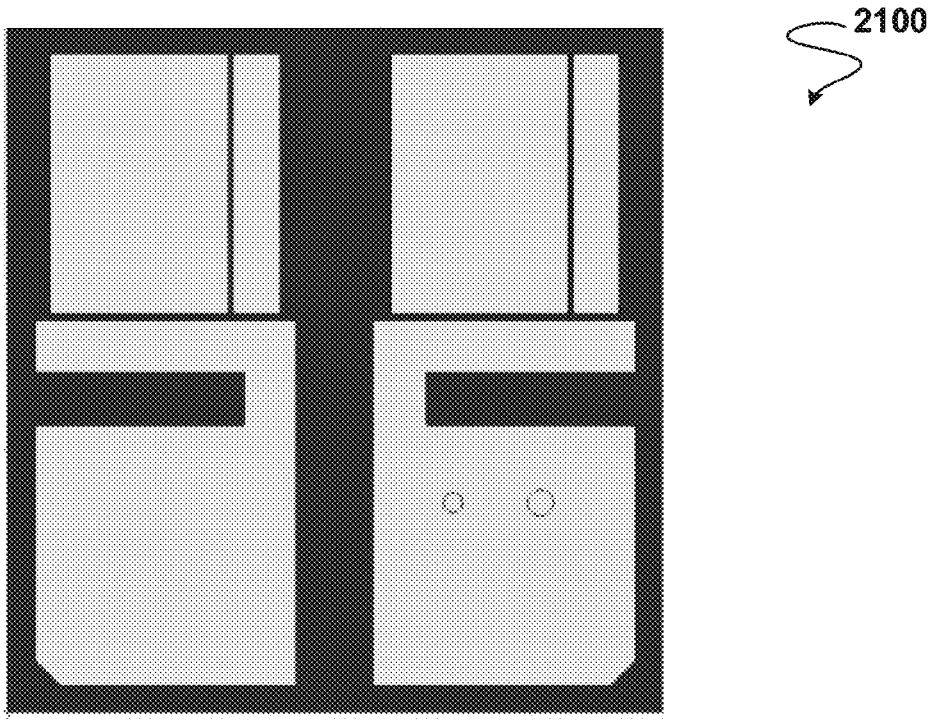
FIG. 21 shows a planner schematic view of the antenna structure in FIG. 20 but with the capacitors not loaded.
Figure 22:
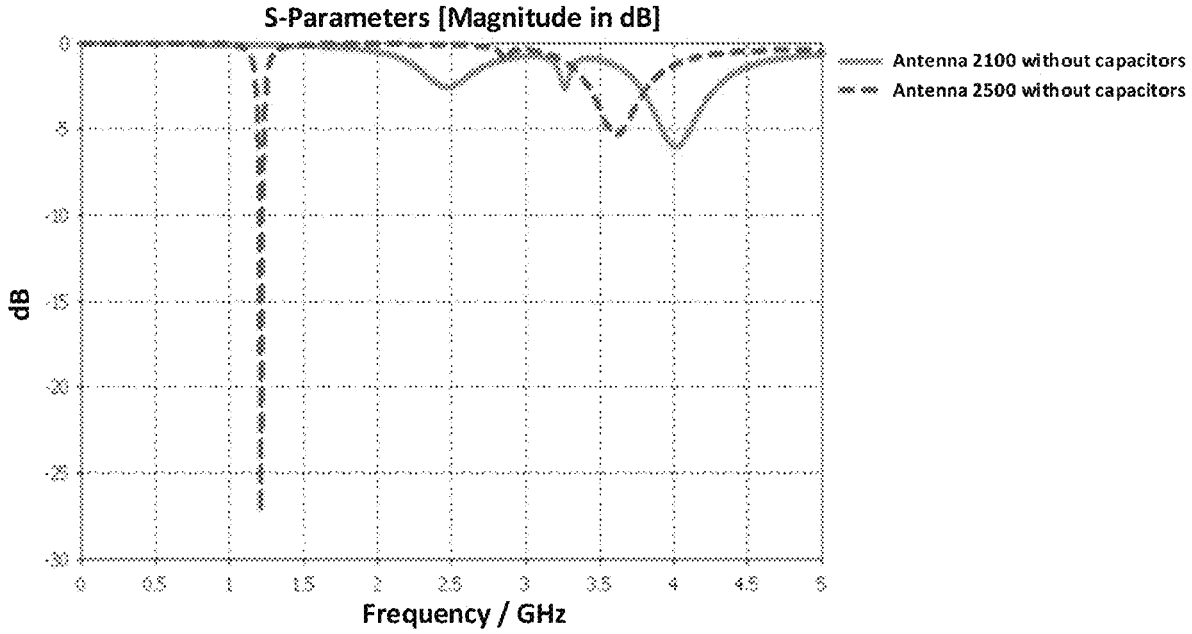
FIG. 22 shows a simulation of a frequency response for the antenna structures in FIG. 22 and FIG. 25, where the resonant frequencies are depicted.
Figure 23:
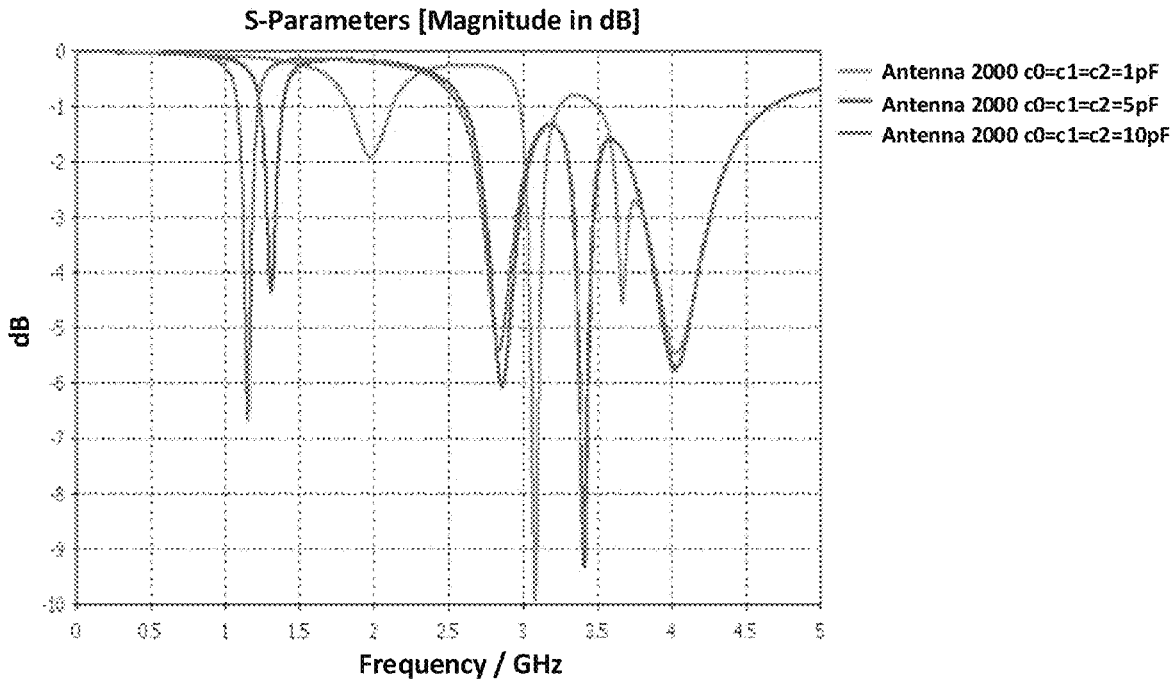
FIG. 23 shows a simulation of a frequency response for the antenna structure in FIG. 20 and where the resonant frequencies are depicted for three capacitance values.

FIG. 20 shows a schematic planner view of a patch antenna according to an embodiment of the invention similar to that of FIG. 1 but in which the metallization pads 2002 and 2003 are substantially parallel to one another and are oriented vertically (i.e. substantially perpendicular) to metallization pad 2001. The pad orientation according to this configuration prevents signal overlap. As such, as shown in FIG. 20, there is no need for DC bias (i.e. there is no need for the DC blocking capacitor). The polarity in the antenna structure is shown in FIG. 20. It is shown that due to the lack of the DC blocking capacitor, no shared polarity is shown. FIG. 21 shows a schematic planner view of a patch antenna identical to that in FIG. 20 but without the capacitors loaded in the structure. FIG. 22 shows a simulation of the frequency response, where the resonant frequency is depicted in solid line for the antenna structure of FIG. 21. FIG. 23 shows a simulation of the frequency response for the patch antenna structure of FIG. 20 and subject to the same condition as previous simulations. The resonant frequencies are shown to vary with varying capacitance. In FIG. 23, the simulation is run by setting all tunable variable capacitors to be equal and with varying the capacitance value to 1 pF, 5 pF and 10 pF for each simulation.

The antenna structure in the embodiment of FIG. 20 is different from that shown in previous embodiments in terms of electrical field line as well as current distribution. Also, the capacitive coupling in the horizontal orientation is more than the vertical with the feeder patch. Such differences affect the resonant frequency and its characteristics.

Figure 24:
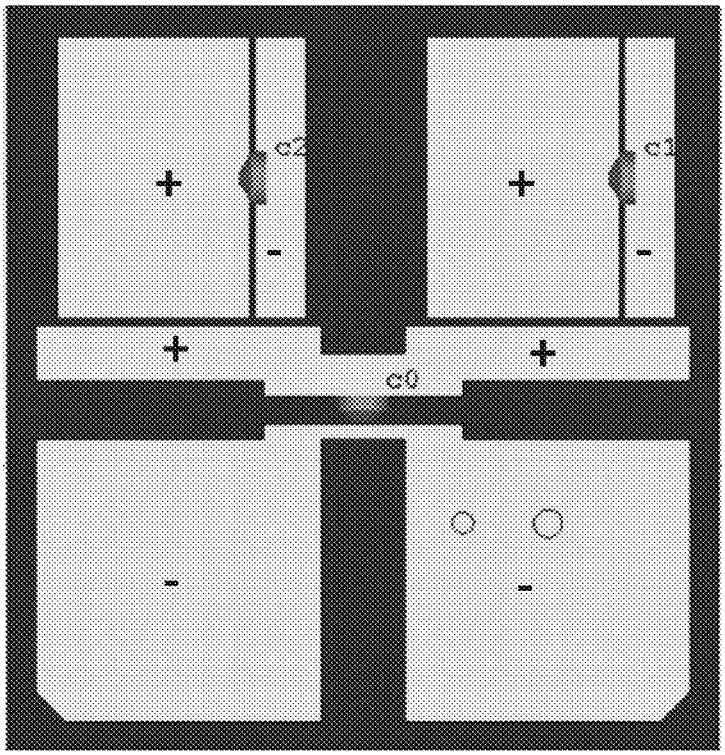
FIG. 24 shows a planner schematic view of an antenna structure allowing for agile frequency tuning according to another embodiment of the invention.
Figure 25:
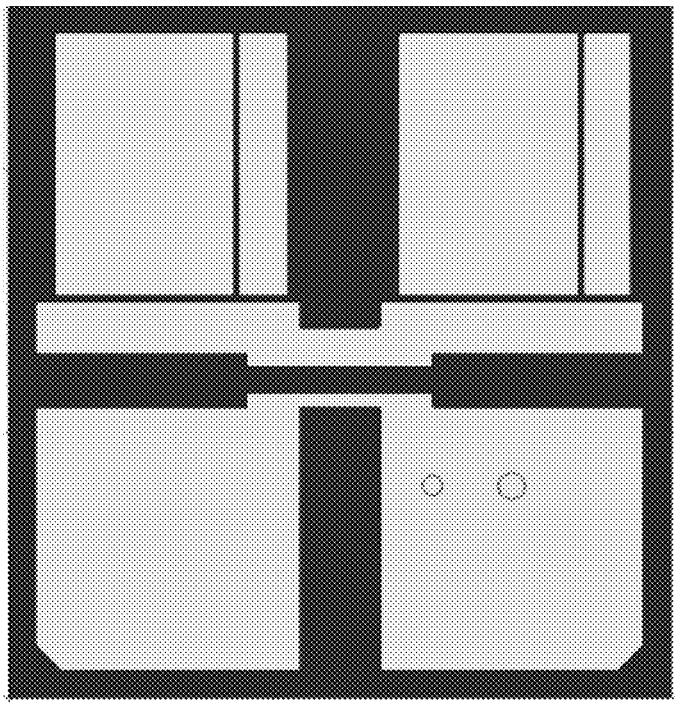
FIG. 25 shows a planner schematic view of the antenna structure in FIG. 24 but with the capacitors not loaded.

FIG. 24 shows a variation on the patch antenna structure of FIG. 20. In FIG. 24, metallization pads 2410 and 2403 are substantially parallel to one another and are oriented vertically (i.e. substantially perpendicular) to metallization pad 2402, which in turn is parallel in orientation to main metallization pad 2401. Due to the vertical orientation of pads 2403 and 2410, DC blocking capacitors are not required in this embodiment. FIG. 25 shows a schematic planner view of a patch antenna identical to that of FIG. 24 but with the capacitors not loaded on the antenna structure.

Figure 26:
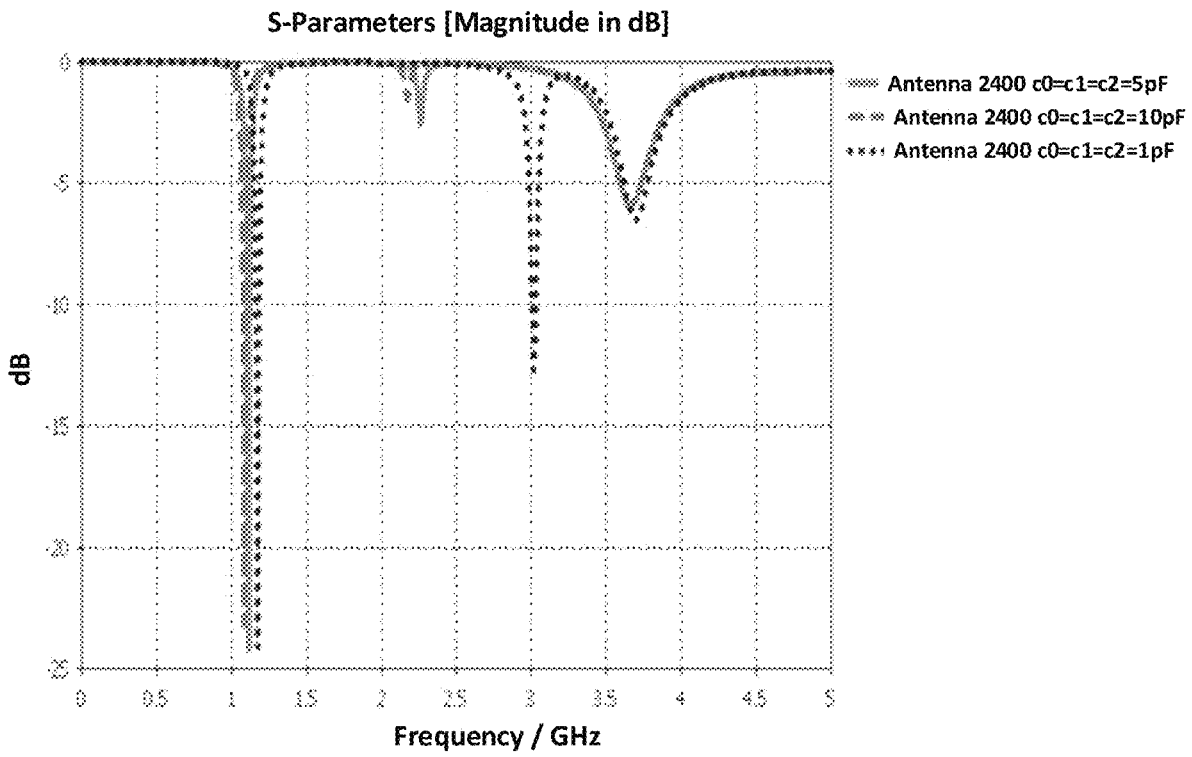
FIG. 26 shows a simulation of a frequency response for the antenna structure in FIG. 24 and where the resonant frequencies are depicted for three capacitance values.

FIG. 22 shows a simulation of the frequency response, in dashed line, to the structure of FIG. 25 under the same simulation conditions as the previous examples provided in this disclosure. The resonant frequency is depicted for the antenna structure in FIG. 25. FIG. 26 shows a simulation of the frequency response to the antenna structure of FIG. 24, under the same simulation conditions and where the resonant frequency is depicted. The resonant frequencies are shown to vary with varying capacitance. In FIG. 26, the simulation is run by setting all tunable variable capacitors to be equal and with varying the capacitance value to 1 pF, 5 pF and 10 pF for each simulation.

In this disclosure, different embodiments are presented. In some embodiments, the metallization pads are parallel to one another and in the same orientation as one another. In other embodiments, the metallization pads are parallel to each other but are vertical to the main metallization pads. It is contemplated within the scope of this disclosure other embodiments, where each of the secondary metallization pads may have a different orientation from the other in relation to the main metallization pad. The different simulation provided in this disclosure showed that the resonant frequency of the patch antenna for each of presented embodiments is different from the one shown for an antenna having a single metallization structure.

The current invention described multiple embodiments in which multiple frequency characteristics are achieved using a single antenna structure, that is more compact in size in comparison to other antenna structures known in the field, due to the patterned metallization. The disclosed patch antenna structure achieves such characteristics by a combination of dividing the metallization patch into multiple sections and varying the electrical length of the antenna structure using capacitance coupling between the divided sections, where the capacitors are tunable variable capacitors. The number of tunable capacitors is such that independent varying of frequency and bandwidth is achieved. DC blocking capacitance may also be used to prevent DC bias applied to the variable capacitors to be propagated back to the antenna input port. Such design structure exhibits low losses and better matching when tuned over radio frequency ranges known in the art. The performance of any antenna subject to this invention will depending on the various factors such the material involved in the fabrication in terms of substrate and metallization.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

"subject" refers to a human or other animal. It is intended that the term encompass patients, such as vocally-impaired patients, as well as inpatients or outpatients with which the present invention is used as a diagnostic or monitoring device. It is also intended that the present invention be used with healthy subjects (i.e., humans and other animals that are not vocally-impaired, nor suffering from disease). Further, it is not intended that the term be limited to any particular type or group of humans or other animals.

"power source" and "power supply" refer to any source of electrical power in a form that is suitable for operating electronic circuits.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", "upper", "lower" and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of device and method have been described herein for purposes of illustration. These are only examples. The technology provided herein can be applied to device and method other than the examples described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A frequency agile antenna comprising:

an electrically conductive ground plane;

an electrically conductive patch metallization plane;

a dielectric plane positioned between the ground plane and the patch metallization plane, the dielectric plane substantially parallel to each of the ground plane and the patch metallization plane;

the patch metallization plane comprising:

a first part extending along a width of the dielectric plane, the first part having a first metallization slot and a second metallization slot separated from each other by a first spacing and connected to each other at one edge by a first connecting metallization, the first metallization slot having a PIN and an input port;

a second part extending along the width of the dielectric plane and separated from the first part by a spacing, the second part having a first metallization slot and a second metallization slot separated from each other by a second spacing and connected to each other at one edge by a second connecting metallization that is positioned opposite the first connecting metallization, the spacing having two wide sections mirrored along an axis formed by a narrow section formed between the first connecting metallization and second connecting metallization, the second part is coupled to the first part at the narrow section by a tuning capacitor;

a third metallization slot coupled at one side to a fourth metallization slot by a second tuning capacitor, the third and fourth metallization slots having an orientation substantially vertical to the first metallization slot of the second part and are separated from the first metallization slot of the second part by a third spacing; and a fifth metallization slot coupled at one side to a sixth metallization slot by a third tuning capacitor, the fifth and sixth metallization slots having an orientation substantially vertical to the second metallization slot of the second part and are separated from the second metallization slot of the second part by a fourth spacing;

wherein the tuning capacitor, the second tuning capacitor and the third tuning capacitor are configured for independently varying a bandwidth and a frequency of the frequency agile antenna.

2. The frequency agile antenna of claim 1, wherein the first metallization slot and the second metallization slot of the first part, the first metallization slot and the second metallization slot of the second part, the third, fourth, fifth and sixth metallization slots all have the same width.

3. The frequency agile antenna of claim 2, wherein each of the first metallization slot and the second metallization slot in the first part have a substantially similar first length, the first metallization slot and the second metallization slot in the second part have a substantially similar second length, the third metallization slot is different in length from the fourth metallization slot, the fifth metallization slot is different in length from the sixth metallization slot and the first length is longer than each of the second length, the third, fourth, fifth and sixth metallization slots.

4. The frequency agile antenna of claim 1, wherein the third metallization slot is separated from the fourth metallization slot by a fifth spacing, the fifth metallization slot is separated from the sixth metallization slot by a sixth spacing, and wherein the spacing, the third, fourth, fifth and sixth spacings are different from one another.

5. The frequency agile antenna of claim 1, wherein the tuning capacitor is different from the second tuning capacitor and the third tuning capacitor and wherein the tuning capacitor is tunable to change the coupling between the first part and the second part.

6. The frequency agile antenna of claim 1 further comprising a control system for configuring the tuning capacitor, the second tuning capacitor and the third tuning capacitor to achieve a desired operational frequency and bandwidth, the control system comprising a processor configured to:

obtain the desired operational frequency and bandwidth as an input;

access a lookup table comprising different sets of capacitance values for the tuning capacitor, the second tuning capacitor and the third tuning capacitor, the different sets of capacitance values corresponding to capacitance values for different pre-determined operational frequencies and bandwidths;

select from the lookup table a set of capacitance values corresponding to the desired operational frequency and bandwidth; and vary the capacitance of the tuning capacitor in the first and second part and the second tuning capacitor to correspond to the selected capacitance values.

7. A frequency agile antenna comprising:

an electrically conductive ground plane;

an electrically conductive patch metallization plane;

a dielectric plane positioned between the ground plane and the patch metallization plane, the dielectric plane substantially parallel to each of the ground plane and the patch metallization plane;

the patch metallization plane comprising:

a first part extending along a width of the dielectric plane, the first part having a first metallization slot and a second metallization slot separated from each other by a first spacing and connected to each other at one edge by a first connecting metallization, the first metallization slot having a PIN and an input port;

a second part extending along the width of the dielectric plane and separated from the first part by a spacing, the second part having a first metallization slot and a second metallization slot separated from each other by a second spacing and connected to each other at one edge by a second connecting metallization that is positioned opposite the first connecting metallization, the spacing having two wide sections mirrored along an axis formed by a narrow section formed between the first connecting metallization and the second connecting metallization, the second part is coupled to the first part at the narrow section by a tuning capacitor;

a third metallization slot coupled at one side to a fourth metallization slot by a second tuning capacitor, the third and fourth metallization slots having the same width, the third metallization slot coupled to the first metallization slot of the second part by a first DC blocking capacitor; and a fifth metallization slot coupled at one side to a sixth metallization slot by a third tuning capacitor, the fifth and sixth metallization slots having the same width, the fifth metallization slot coupled to the second metallization slot of the second part by a second DC blocking capacitor;

wherein the tuning capacitor, the second tuning capacitor and the third tuning capacitor are configured for independently varying a bandwidth and a frequency of the frequency agile antenna.

8. The frequency agile antenna of claim 7, wherein the first metallization slot and a second metallization slot of the first part, the first metallization slot and a second metallization slot of the second part, the third, fourth, fifth and sixth metallization slots all have the same width.

9. The frequency agile antenna of claim 8, wherein the first metallization slot and the second metallization slot in the first part have a substantially similar first length, the first metallization slot and the second metallization slot in the second part have a substantially similar second length, the third metallization slot is different in length from the fourth metallization slot, the fifth metallization slot is different in length from the sixth metallization slot and the first length is longer than each of the second length, the third, fourth, fifth and sixth metallization slots.

10. The frequency agile antenna of claim 7, wherein the third metallization slot is separated from the fourth metallization slot by a fifth spacing, the fifth metallization slot is separated from the sixth metallization slot by a sixth spacing, and wherein the spacing, the third, fourth, fifth and sixth spacings are different from one another.

11. The frequency agile antenna of claim 7, wherein the tuning capacitor is different from the second tuning capacitor and the third tuning capacitor and wherein the tuning capacitor is tunable to change the coupling between the first part and the second part.

12. The frequency agile antenna of claim 7 further comprising a control system for configuring the tuning capacitor, the second tuning capacitor and the third tuning capacitor to achieve a desired operational frequency and bandwidth, the control system comprising a processor configured to:

obtain the desired operational frequency and bandwidth as an input;

access a lookup table comprising different sets of capacitance values for the tuning capacitor, the second tuning capacitor and the third tuning capacitor, the different sets of capacitance values corresponding to capacitance values for different pre-determined operational frequencies and bandwidths;

select from the lookup table a set of capacitance values corresponding to the desired operational frequency and bandwidth; and vary the capacitance of the tuning capacitor in the first and second part and the second tuning capacitor to correspond to the selected capacitance values.

* * * * *